US011173629B2

(12) United States Patent
Dubey et al.

(10) Patent No.: US 11,173,629 B2
(45) Date of Patent: Nov. 16, 2021

(54) CONTINUOUS MIXER AND METHOD OF MIXING REINFORCING FIBERS WITH CEMENTITIOUS MATERIALS

(71) Applicant: UNITED STATES GYPSUM COMPANY, Chicago, IL (US)

(72) Inventors: Ashish Dubey, Grayslake, IL (US); Peter B. Groza, Antioch, IL (US); Christopher R. Nelson, Lindenhurst, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 1070 days.

(21) Appl. No.: 15/662,932

(22) Filed: Jul. 28, 2017

(65) Prior Publication Data

US 2018/0036911 A1 Feb. 8, 2018

Related U.S. Application Data

(60) Provisional application No. 62/371,578, filed on Aug. 5, 2016.

(51) Int. Cl.
*B28C 7/04* (2006.01)
*B28C 5/12* (2006.01)
(Continued)

(52) U.S. Cl.
CPC ..... *B28C 7/0418* (2013.01); *B01F 7/001* (2013.01); *B01F 7/00158* (2013.01); *B01F 7/04* (2013.01);
(Continued)

(58) Field of Classification Search
CPC ..... B28C 7/0418; B28C 5/402; B28C 5/1246; B28C 5/1238; B28C 5/143; B28C 5/148;
(Continued)

(56) References Cited

U.S. PATENT DOCUMENTS 3,284,980 A 11/1966 Dinkel
3,354,031 A 11/1967 Kozacik
(Continued)

FOREIGN PATENT DOCUMENTS

CL 2007003152 A1 4/2008
CL 2009000371 A1 10/2009
(Continued)

OTHER PUBLICATIONS

Office Action dated May 27, 2020 from Chinese Patent Application No. 201780045714.6 to United States Gypsum Company.
(Continued)

*Primary Examiner* — Charles Cooley
(74) *Attorney, Agent, or Firm* — Vorys, Sater, Seymour and Pease LLP; Pradip Sahu; Philip T. Petti

(57) ABSTRACT

A method in which a stream of dry cementitious powder passes through a first conduit and aqueous medium stream passes through a second conduit to feed a slurry mixer to make cementitious slurry. The cementitious slurry passes through a third conduit and a reinforcement fiber stream passes through a fourth conduit to feed a fiber-slurry mixer which mixes the slurry and discrete fibers to make a stream of fiber-slurry mixture. An apparatus for performing the method is also disclosed.

16 Claims, 11 Drawing Sheets

(51) Int. Cl.

| | |
|---|---|
| ***B01F 7/00*** | (2006.01) |
| ***B28B 19/00*** | (2006.01) |
| ***B01F 13/10*** | (2006.01) |
| ***B01F 7/04*** | (2006.01) |
| ***B28C 5/14*** | (2006.01) |
| ***B28C 5/40*** | (2006.01) |
| ***B28C 9/00*** | (2006.01) |
| ***B28B 1/52*** | (2006.01) |
| ***B28B 13/02*** | (2006.01) |
| ***B01F 15/02*** | (2006.01) |
| ***B01F 3/12*** | (2006.01) |
| ***B05C 1/08*** | (2006.01) |

(52) U.S. Cl.

CPC ..... *B01F 13/1027* (2013.01); *B28B 1/522* (2013.01); *B28B 13/0275* (2013.01); *B28B 19/0092* (2013.01); *B28C 5/1276* (2013.01); *B28C 5/1284* (2013.01); *B28C 5/148* (2013.01); *B28C 5/402* (2013.01); *B28C 9/004* (2013.01); *B01F 3/1221* (2013.01); *B01F 7/048* (2013.01); *B01F 2013/1052* (2013.01); *B01F 2015/0221* (2013.01); *B05C 1/0834* (2013.01)

(58) Field of Classification Search

CPC ..... B28C 5/146; B28C 5/1284; B28C 5/1276; B28C 9/004; B28B 5/027; B28B 3/224; B28B 1/526; B28B 1/522; B28B 13/0275; B28B 19/0092; B01F 7/00708; B01F 7/085; B01F 7/042; B01F 7/0065; B01F 3/1221; B01F 2015/0221; B01F 3/2042; B01F 7/048; B01F 7/00158; B01F 13/1027; B01F 7/001; B01F 7/04; B01F 2013/1052; B29B 7/483; B29B 7/482; B29B 7/90; B29B 7/488; B29B 7/72; B29B 7/44; B29C 48/67; B05C 1/0834

See application file for complete search history.

(56) References Cited

U.S. PATENT DOCUMENTS

| | | | | |
|---|---|---|---|---|
| 3,785,621 | A | 1/1974 | Hoskins | |
| 3,885,774 | A | 5/1975 | Harris et al. | |
| 3,972,972 | A | 8/1976 | Yano et al. | |
| 4,093,471 | A | 6/1978 | Greig | |
| 4,187,275 | A | 2/1980 | Bracalielly et al. | |
| 4,205,919 | A | 6/1980 | Attwell | |
| 4,298,413 | A | 11/1981 | Teare | |
| 4,450,022 | A | 5/1984 | Galer | |
| 4,504,533 | A | 3/1985 | Altenhofer et al. | |
| 4,793,892 | A | 12/1988 | Miller et al. | |
| 5,018,673 | A * | 5/1991 | Eirich | B01F 7/00708 241/62 |
| 5,051,221 | A * | 9/1991 | Bold | B28C 5/40 |
| 5,221,386 | A | 6/1993 | Ensminger et al. | |
| 5,306,452 | A | 4/1994 | Todd | |
| 5,366,676 | A | 11/1994 | Kobayashi | |
| 5,891,374 | A | 4/1999 | Shah et al. | |
| 5,902,528 | A | 5/1999 | Spragg | |
| 6,248,156 | B1 | 6/2001 | Lucas | |
| 6,248,214 | B1 | 6/2001 | Stotz et al. | |
| 6,299,970 | B1 | 10/2001 | Richards et al. | |
| 6,620,487 | B1 | 9/2003 | Tonyan et al. | |
| 6,986,812 | B2 | 1/2006 | Dubey et al. | |
| 7,049,251 | B2 | 5/2006 | Porter | |
| 7,347,895 | B2 | 3/2008 | Dubey | |
| 7,347,896 | B2 | 3/2008 | Harrison | |
| 7,354,876 | B2 | 4/2008 | Porter et al. | |
| 7,384,514 | B2 | 6/2008 | Walters et al. | |
| 7,416,636 | B2 | 8/2008 | Blomqvist et al. | |
| 7,513,963 | B2 | 4/2009 | Frank et al. | |
| 7,524,386 | B2 | 4/2009 | George et al. | |
| 7,615,504 | B2 | 11/2009 | Porter et al. | |
| 7,670,520 | B2 | 3/2010 | Dubey | |
| 7,732,032 | B2 | 6/2010 | Dubey | |
| 7,754,052 | B2 | 7/2010 | Frank et al. | |
| 7,794,221 | B2 | 9/2010 | Dubey | |
| 7,842,629 | B2 | 11/2010 | Jaffee | |
| 7,845,130 | B2 | 12/2010 | Tonyan et al. | |
| 7,846,536 | B2 | 12/2010 | Dubey | |
| 7,870,698 | B2 | 1/2011 | Tonyan et al. | |
| 7,897,079 | B2 | 3/2011 | Miller | |
| 7,989,370 | B2 | 8/2011 | Currier et al. | |
| 8,030,377 | B2 | 10/2011 | Dubey et al. | |
| 8,038,790 | B1 * | 10/2011 | Dubey | B28B 1/522 106/675 |
| 8,038,915 | B2 | 10/2011 | Stivender | |
| 8,057,915 | B2 | 11/2011 | Song et al. | |
| 8,061,108 | B2 | 11/2011 | Tonyan et al. | |
| 8,061,257 | B2 | 11/2011 | Tonyan et al. | |
| 8,062,741 | B2 | 11/2011 | Tonyan et al. | |
| 8,065,853 | B2 | 11/2011 | Tonyan et al. | |
| 8,069,633 | B2 | 12/2011 | Tonyan et al. | |
| 8,128,767 | B2 | 3/2012 | Jaffee | |
| 8,137,490 | B2 | 3/2012 | Frank et al. | |
| 8,163,352 | B2 | 4/2012 | Jones | |
| 8,461,067 | B2 | 6/2013 | Smith et al. | |
| 8,568,544 | B2 | 10/2013 | Engbrecht et al. | |
| 8,727,254 | B2 | 5/2014 | Lucas et al. | |
| 8,770,139 | B2 | 7/2014 | Frank et al. | |
| 10,272,399 | B2 * | 4/2019 | Dubey | B01F 7/083 |
| 10,646,837 | B2 * | 5/2020 | Dubey | B01F 15/0251 |
| 2003/0146539 | A1 | 8/2003 | Chen et al. | |
| 2004/0219845 | A1 | 11/2004 | Graham et al. | |
| 2005/0064164 | A1 | 3/2005 | Dubey et al. | |
| 2006/0061007 | A1 | 3/2006 | Chen et al. | |
| 2006/0144005 | A1 | 7/2006 | Tonyan et al. | |
| 2006/0168905 | A1 | 8/2006 | Blanc et al. | |
| 2006/0168906 | A1 | 8/2006 | Tonyan et al. | |
| 2006/0174572 | A1 | 8/2006 | Tonyan et al. | |
| 2006/0185267 | A1 | 8/2006 | Tonyan et al. | |
| 2006/0233043 | A1 * | 10/2006 | Himmelsbach | B08B 17/06 366/147 |
| 2007/0110970 | A1 | 5/2007 | Dubey | |
| 2007/0148430 | A1 | 6/2007 | Agrawal | |
| 2007/0149083 | A1 | 6/2007 | Agrawal | |
| 2008/0099133 | A1 | 5/2008 | Stivender | |
| 2008/0308968 | A1 | 12/2008 | Immordino, Jr. | |
| 2009/0218720 | A1 * | 9/2009 | Chen | B29C 48/405 264/211.23 |
| 2009/0239977 | A1 | 9/2009 | Dubey et al. | |
| 2010/0143682 | A1 | 6/2010 | Shake et al. | |
| 2010/0151757 | A1 | 6/2010 | Herbert et al. | |
| 2011/0186664 | A1 | 8/2011 | Lucas et al. | |
| 2012/0219747 | A1 | 8/2012 | Kanao | |
| 2012/0231233 | A1 | 9/2012 | Kanao | |
| 2013/0075051 | A1 | 3/2013 | Thomisch et al. | |
| 2013/0186989 | A1 | 7/2013 | Lucas et al. | |
| 2013/0337251 | A1 | 12/2013 | Grassl | |
| 2014/0231560 | A1 | 8/2014 | Lucas et al. | |
| 2014/0239105 | A1 | 8/2014 | Lucas et al. | |
| 2014/0272404 | A1 | 9/2014 | Shake et al. | |
| 2018/0036693 | A1 * | 2/2018 | Dubey | B01F 7/085 |
| 2018/0036909 | A1 | 2/2018 | Dubey et al. | |
| 2018/0036911 | A1 * | 2/2018 | Dubey | B01F 7/04 |
| 2018/0036912 | A1 * | 2/2018 | Dubey | B28C 5/1238 |
| 2019/0217259 | A1 * | 7/2019 | Dubey | B01F 7/06 |

FOREIGN PATENT DOCUMENTS

| | | | |
|---|---|---|---|
| CN | 1205264 | A | 1/1999 |
| CN | 2344149 | Y | 10/1999 |
| CN | 1235729 | C | 1/2006 |
| CN | 204093355 | U | 1/2015 |
| DE | 1007684 | B | 5/1957 |
| DE | 2312436 | A1 | 10/1973 |
| DE | 10060328 | C1 | 12/2001 |
| DE | 102008058222 | A1 | 5/2010 |
| EP | 0003705 | B1 | 9/1982 |
| EP | 1653000 | A1 | 5/2006 |

(56) References Cited

FOREIGN PATENT DOCUMENTS

| | | | |
|---|---|---|---|
| GB | 1085592 | A | 10/1967 |
| GB | 2048446 | A | 12/1980 |
| GB | 2166660 | A | 5/1986 |
| JP | S5743805 | A | 3/1982 |
| JP | H04189104 | A | 7/1992 |
| JP | H08118330 | A | 5/1996 |
| JP | 2763059 | A | 6/1998 |
| JP | 2003127129 | A | 5/2003 |
| JP | 2003516880 | A | 5/2003 |
| JP | 2008207140 | A | 9/2008 |
| JP | 4454715 | B2 | 4/2010 |
| WO | 2009085981 | A2 | 7/2009 |
| WO | 2009142791 | A2 | 11/2009 |
| WO | 2009152615 | A1 | 12/2009 |
| WO | 2018/027090 | * | 2/2018 |

OTHER PUBLICATIONS

Office Action dated May 27, 2020 from Chinese Patent Application No. 201780047253.6 to United States Gypsum Company with machine translatio.

International Search Report and Written Opinion dated Oct. 24, 2017 for PCT/US2017/045420 to United States Gypsum Company filed Aug. 4, 2017.

USG Building Envelope Solutions, USG SECUROCK® Brand Glass-Mat Sheathing Regular and FIRECODE® X, USG Corporation, 2015.

Application of PID neural network in headbox multivariable decoupling control (only Abstract), IEEE, pp. 2427-2430, ISBN 978-1-4577-1414-6, 2012.

Tucker et al., Production of Glass Fibers for Reinforcement of Lunar Concrete, Conference: 44th AIAA Aerospace Sciences Meeting and Exhibit, Jan. 2006), DOI: 10.2514/6.2006-523, URL: <https://www.researchgate.net/publication/268564326_Production_of_Glass_Fibers_for_Reinforcement_of_Lunar_Concrete>, Retrieved from the Internet Jun. 22, 2017.

O'Connell, Development of a New High Performance Synthetic Fiber for Concrete Reinforcement, Master's Thesis, Dalhousie University, Jul. 5, 2011.

Technical Guidelines, Pictorial Atlas of Concrete Repair Equipment, International Concrete Repair Institute, (ICRI) Guideline No. 320.5R-2014, May 2014.

Naaman, Engineered Steel Fibers with Optimal Properties for Reinforcement of Cement Composites, Journal of Advanced Concrete Technology vol. 1, No. 3, 241-252, Nov. 2003, Japan Concrete Institute.

Bentur et al., Fibre Reinforced Cementitious Composites, Modern Concrete Technology Series, Taylor & Francis Group, 2007.

Martin Christopher Tr¨ub, Numerical Modeling of High Performance Fiber Reinforced Cementitious Composites, ETH No. 19437, ETH Zurich, 2011.

Pan Mixers, Pan Mixers from Steelfields, URL: <http://steelfields.com/mixers/pan-mixers/>, Retrieved from the Internet Jun. 21, 2016.

Paddle Mixers, Paddle Mixers from Steelfields, URL:<http://steelfields.com/mixers/paddle-mixers/>, Retrieved from the Internet Jun. 21, 2016.

Majumdar et al, Glass fibre reinforced cement, Material Science and Engineering, vol. 15, Issue 2-3, Aug.-Sep. 1974, pp. 107-127 (Abstract only), URL : < http://www.sciencedirect.com/science/article/pii/0025541674900433> , retrieved from the Internet Jun. 22, 2016.

Office Action dated Jun. 1, 2021 from Japanese Patent Application No. 2019-502190 to United States Gypsum Company.

* cited by examiner

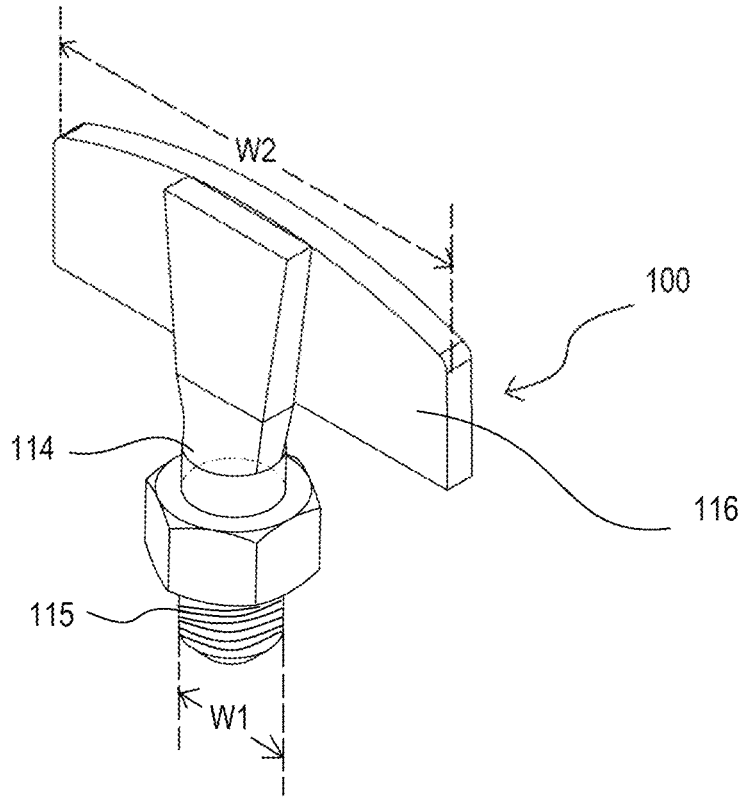
FIG. 4
FIG. 5
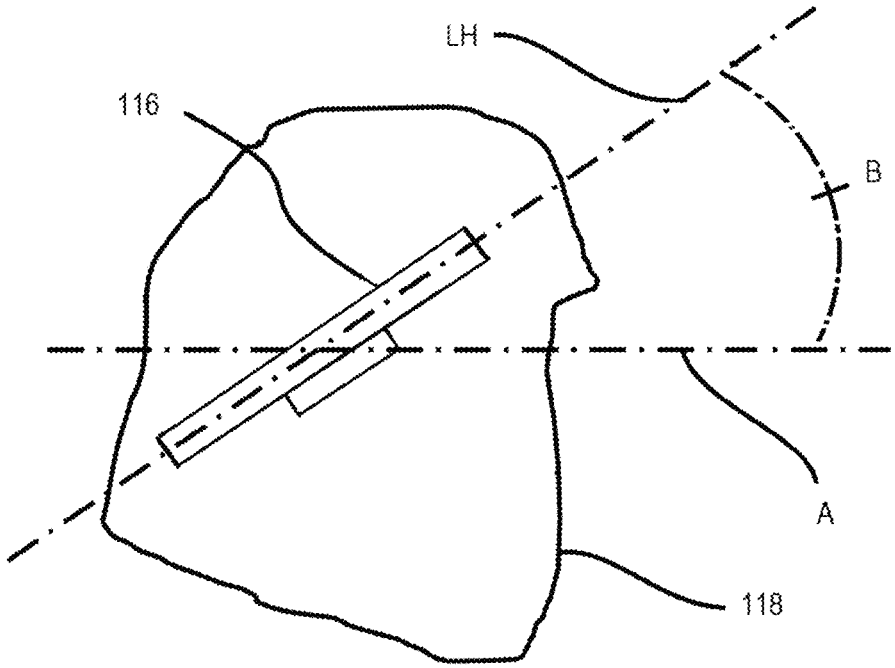

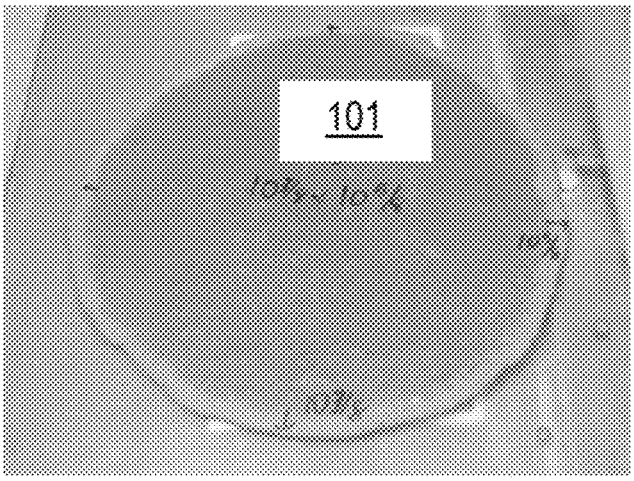
FIG. 14
FIG. 15
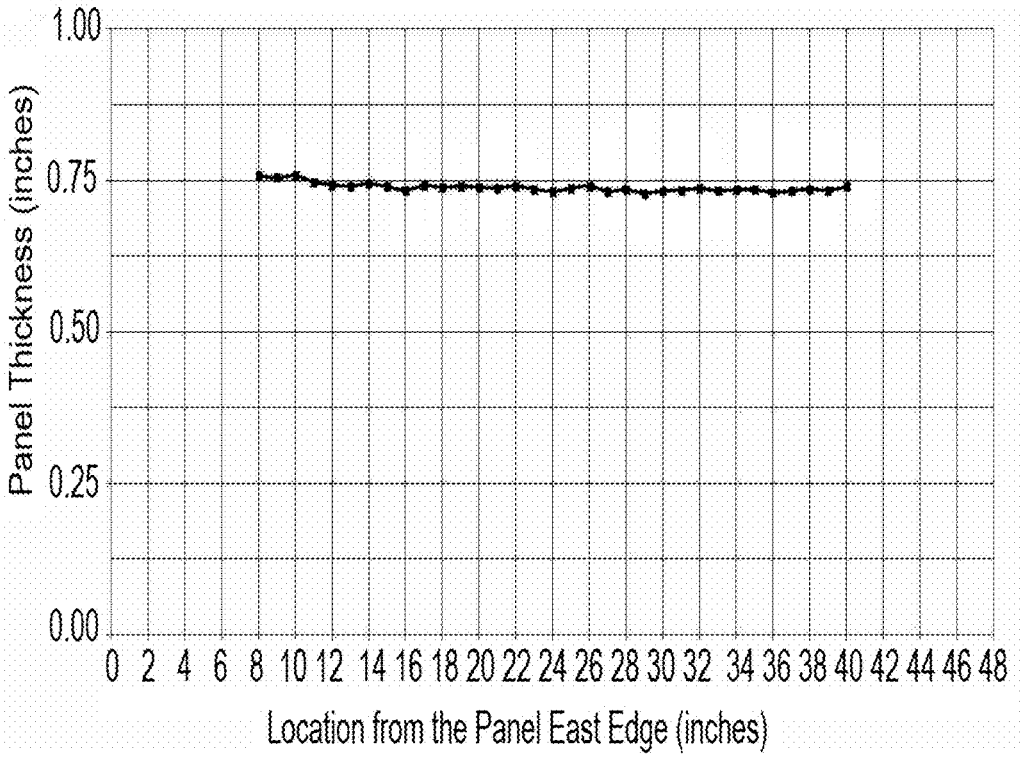

CONTINUOUS MIXER AND METHOD OF MIXING REINFORCING FIBERS WITH CEMENTITIOUS MATERIALS

CROSS REFERENCE TO RELATED APPLICATIONS

This application is related to:

U.S. Provisional Patent Application No. 62/371,554 filed Aug. 5, 2016, entitled CONTINUOUS METHODS OF MAKING FIBER REINFORCED CONCRETE PANELS, filed Aug. 5, 2016;

U.S. Provisional Patent Application No. 62/371,569 filed Aug. 5, 2016, entitled HEADBOX AND FORMING STATION FOR FIBER REINFORCED CEMENTITIOUS PANEL PRODUCTION, filed Aug. 5, 2016;

U.S. Provisional Patent Application No. 62/371,590, entitled A METHOD FOR PRODUCING FIBER REINFORCED CEMENTITIOUS SLURRY USING A MULTI-STAGE CONTINUOUS MIXER, filed Aug. 5, 2016;

all herein incorporated by reference in their entirety.

This application claims the benefit of U.S. Provisional Patent Application No. 62/371,578 entitled CONTINUOUS METHODS OF MAKING FIBER REINFORCED CONCRETE PANELS, filed Aug. 5, 2016 incorporated by reference in its entirety.

FIELD OF THE INVENTION

This invention discloses a continuous mixer and a method of mixing reinforcing fibers with cementitious materials for producing fiber reinforced cementitious materials in a continuous process.

BACKGROUND OF THE INVENTION

U.S. Pat. No. 6,986,812 to Dubey et al., incorporated herein by reference in its entirety, features a slurry feed apparatus for use in a structural cement panel (SCP) production line or the like application where settable slurries are used in the production of building panels or board. The apparatus includes a main metering roll and a companion roll placed in close, generally parallel relationship to each other to form a nip in which a supply of slurry is retained. Both rolls preferably rotate in the same direction so that slurry is drawn from the nip over the metering roll to be deposited upon a moving web of the SCP panel production line. A thickness control roll is provided in close operational proximity to the main metering roll for maintaining a desired thickness of the slurry.

U.S. Pat. No. 7,524,386 B2 to George et al, incorporated herein by reference in its entirety, discloses a process employing a wet mixer having a vertical mixing chamber for forming a wet slurry of a cementitious powder and liquid. The vertical mixing chamber is designed to provide the required amount of mixing to provide thoroughly mixed, uniformly thin slurry within a mixing residence time that allows for adequate supply of slurry to ensure continuous operation of an associated cement panel production line. Gravity feed means for supply of cementitious powder and water to the slurry mixing area of the chamber is also disclosed. In preparing the SCP panels, an important step is mixing cementitious powder to form slurry. The slurry is then withdrawn from the bottom of the chamber and pumped through a cavity pump to the slurry feeding apparatus. A typical conventional continuous cement mixer is the DUO MIX2000 continuous cement mixer from M-TEC GmbH, Neuenburg, Germany used in the construction industry to mix and pump concrete slurry.

U.S. Pat. No. 7,513,963 B2 to George et al, incorporated herein by reference in its entirety, discloses a wet mixer apparatus and method for its use, the mixer having a vertical mixing chamber for forming a wet slurry of a cementitious slurry and water. The vertical mixing chamber is designed to provide the required amount of mixing to provide thoroughly mixed, uniformly thin slurry within a mixing residence time that allows for adequate supply of slurry to ensure continuous operation of an associated cement panel production line. Gravity feeding for separate supply of cementitious powder and water to the slurry mixing area of the chamber without pre-mixing of the powder and water is also disclosed.

U.S. Pat. No. 8,038,790 to Dubey et al., incorporated herein by reference in its entirety, discloses structural cement panel for resisting transverse and shear loads equal to transverse and shear loads provided by plywood and oriented strain board, when fastened to framing for use in shear walls, flooring and roofing systems. The panels provide reduced thermal transmission compared to other structural cement panels. The panels employ one or more layers of a continuous phase resulting from curing an aqueous mixture of calcium sulfate alpha hemihydrate, hydraulic cement, coated expanded perlite particles filler, optional additional fillers, active pozzolan and lime. The coated perlite has a particle size of 1-500 microns, a median diameter of 20-150 microns, and an effective particle density (specific gravity) of less than 0.50 g/cc. The panels are reinforced with fibers, for example alkali-resistant glass fibers.

US Patent Application Publication No. 2005/0064164 to Dubey et al., incorporated herein by reference in its entirety, discloses a multi-layer process for producing structural cementitious panel which includes: (a) providing a moving web; (b) one of (i) depositing a first layer of individual, loose fibers upon the web, followed by depositing a layer of settable slurry upon the web and (ii) depositing a layer of settable slurry upon the web; (c) depositing a second layer of individual, loose fibers upon the slurry; (d) actively embedding said second layer of individual, loose fibers into the slurry to distribute said fibers throughout the slurry; and (e) repeating steps (ii) through (d) until the desired number of layers of settable fiber-enhanced slurry is obtained and so that the fibers are distributed throughout the panel. Also provided are a structural panel produced by the process, an apparatus suitable for producing structural cementitious panels according to the process, and a structural cementitious panel having multiple layers, each layer created by depositing a layer of settable slurry upon a moving web, depositing fibers upon the slurry and embedding the fibers into the slurry such that each layer is integrally formed with the adjacent layers.

US Patent Application Publication No. 2006/0061007 to Chen et al. discloses a method and apparatus for extruding cementitious articles. The extruder includes a casing with a pair of inter-meshing self-wiping screws rotatably mounted therein. The screws continuously mix and knead the components of the fiber cement provided through various feed means to form a substantially homogeneous paste and force the paste through a die to form a green cementitious extrudate suitable for casting. Cementitious mixtures for extruding are very viscous and not suitable for uses such as shotcrete or deposition through a forming assembly on a cementitious panel production line.

The current state-of-the-art mixing technology for producing fiber reinforced cementitious slurry typically involves use of industry standard batch mixers into which all raw materials including reinforcing fibers are first added and then mixed for several minutes to yield a slurry mixture with randomly dispersed fibers. Rotating drum and rotating pan mixers are examples of concrete mixers that are commonly used for preparing fiber reinforced cementitious slurry mixtures. Some major limitations and drawbacks of the current state-of-the art concrete mixers and mixing technologies for producing fiber reinforced cementitious slurry mixtures include:

The mixing operation in a batch mixer is not continuous thus making their use more difficult in applications where a continuous supply of slurry is needed such as in the case of a continuous panel production line.

The mixing time in a batch mixer is typically very long, in the order of several minutes, to obtain a well-blended, homogeneous slurry mixture.

Since a large amount of fibers are added at a time in a batch mixer, that leads to fiber lumping and balling during the mixing operation and production of slurries with extremely high viscosities.

Longer mixing times involved with the batch mixing process tend to damage and break the reinforcing fibers.

Batch mixers are not very useful and practical with respect to handling rapid setting cementitious materials.

There is a need for a single-layer process for producing slurry for cementitious panels having high reinforcing fiber concentrations. Thus, there is a need for an improved wet mixing apparatus that ensures supply of sufficient mixed fluid cementitious slurry which contains reinforcing fibers such as glass fibers or polymeric fibers to supply a continuous panel production line. It is desired to provide a degree of mixing of the cementitious reactive powder, reinforcing fibers, and water in the mixer to result in a slurry of proper rheology and sufficient fluidity to provide a slurry for use in the continuous cementitious panel manufacturing line.

SUMMARY OF THE INVENTION

The present invention features a fiber-slurry wet mixer apparatus for preparing a fiber-slurry mixture. Considering the limitations and drawbacks of the current state-of-the-art concrete mixers, some objectives of the present invention are as follows:

Provide a mixer that allows continuous blending of fibers with the rest of the cementitious components to produce a uniformly mixed fiber reinforced cementitious slurry mixture.

Provide a mixer that reduces the required mixing time from several minutes to less than 60 seconds, preferably less than 30 seconds, to produce a uniformly blended fiber reinforced cementitious slurry mixture.

Provide a mixer that does not cause fiber balling and lumping during the mixing operation.

Provide a mixer that does not cause damage to the reinforcing fibers as a result of the mixing action.

Provide a mixer that produces uniformly blended fiber-slurry mixtures with relatively low viscosities.

Provide a mixer that allows use of rapid setting cementitious materials useful in manufacturing and construction applications.

The invention provides a method for preparing a composite fiber-slurry mixture comprising:

feeding a liquid stream comprising water, into a continuous slurry mixer through a liquid stream inlet and feeding a stream of a dry cementitious powder into the continuous slurry mixer to form a cementitious slurry, said continuous slurry mixer having a horizontally or vertically mounted impeller;

passing the cementitious slurry from the continuous slurry mixer into a single pass horizontal fiber-slurry continuous mixer and passing a stream of reinforcement fibers into the horizontal fiber-slurry continuous mixer and mixing the cementitious slurry and the reinforcement fibers to form a fiber-slurry mixture, the horizontal fiber-slurry continuous mixer comprising an elongated mixing chamber defined by a horizontal (typically cylindrical) housing having an interior side wall, at least one fiber inlet port to introduce reinforcement fibers into the mixing chamber in a first feed section of the horizontal housing, and at least one cementitious slurry inlet port to introduce cementitious slurry mixture into the chamber in a second feed section of the horizontal housing, a fiber-slurry mixture outlet port at a second discharge end section of the horizontal housing to discharge the fiber reinforced cementitious slurry mixture produced by the mixer, and a venting port to remove any air introduced into the mixing chamber from raw material feed, a rotating horizontally oriented shaft mounted within the elongated mixing chamber traversing from one end of the fiber-slurry mixer to another end of the fiber-slurry mixer, a plurality of mixing and conveying paddles mounted on the horizontally oriented shaft of the mixer at regular intervals and different circumferential locations, the paddles rotated about the horizontally oriented shaft within the horizontal housing, the paddle assemblies extending radially from a location on the shaft, the paddle assemblies comprising a pin engaged to a paddle head, the pin pivotally engaged to the horizontally oriented shaft and/or the paddle head to permit pivotal rotation of the paddle head relative to the respective location on the horizontally oriented shaft, wherein the plurality of paddles are arranged to mix the reinforcement fibers and cementitious slurry and move the cementitious slurry and reinforcement fibers being mixed to the fiber-slurry mixture outlet;

wherein the horizontally oriented shaft is externally connected to a drive mechanism and a drive motor, for example, powered by electricity, fuel gas, gasoline, or other hydrocarbon, to accomplish shaft rotation when the mixer is in operation;

wherein the cementitious slurry and fibers are mixed in the mixing chamber of the horizontal fiber-slurry mixer for an average mixing residence time of about 5 to about 240 seconds, preferably 10 to 180 seconds, more preferably 10 to 120 seconds, most preferably 10 to 60 seconds while the rotating paddles apply shear force, wherein the central rotating shaft rotates at 30 to 450 RPM, more preferably 40 to 300 RPM, and most preferably 50 to 250 RPM during mixing, to produce a uniform fiber-slurry mixture having a consistency that will allow the fiber-slurry mixture to be discharged from the fiber-slurry mixer;

discharging the fiber-slurry mixture from the fiber-slurry mixer.

The fiber-slurry mixture discharged from the fiber-slurry mixer of the present invention has a slump of 4 to 11 inches as measured according to a slump test using a 4 inch tall and 2 inch diameter pipe. The fiber-slurry mixture discharged from the horizontal mixer also has a viscosity less than 45000 centipoise, preferably less than 30000 centipoise, more preferably less than 15000 centipoise, and most preferably less than 10000 centipoise when measured using a Brookfield Viscometer, Model DV-II+ Pro with Spindle HA4 attachment running at 20 RPM speed. Typically the resulting fiber-slurry mixtures have a viscosity of at least 1500 centipoise.

The fiber-slurry mixtures typically also include plasticizers and superplasticizers. Plasticizers are commonly manufactured from lignosulfonates, a by-product from the paper industry. Superplasticizers have generally been manufactured from sulfonated naphthalene condensate or sulfonated melamine formaldehyde, caesins, or based on polycarboxylic ethers. The present fiber-slurry mixtures preferably lack thickeners or other additives that substantially increase material viscosity.

The resulting fiber-slurry mixture is a uniform fiber-slurry mixture that has a consistency that will allow the fiber-slurry mixture to be discharged from the horizontal fiber-slurry mixer and be suitable for being deposited as a continuous layer on a moving surface of a panel production line uniformly as a layer 0.25 to 2.00 inches thick, preferably 0.25 to 1 inches thick, more preferably 0.4 to 0.8 inches thick, typically 0.5 to 0.75 inches thick on the moving surface of the panel production line to produce a fiber reinforced concrete (FRC) panel.

The fiber-slurry mixtures discharged from the fiber-slurry mixer are suitable for a variety of uses, for example statuary, shotcrete, consolidation of loose rock on slopes, soil stabilization, tunnel and mine linings, pre-cast concrete products, pavements and bridge decks, concrete slab-on-grade, repair applications, or to make a FRC panel or board.

When using the settable fiber-slurry mixture for producing FRC panel the fiber-slurry mixture is fed to a slurry feed apparatus (known as a "headbox") which deposits the fiber-slurry mixture on a moving surface of a panel production line uniformly as a layer 0.125 to 2 inches thick, preferably 0.25 to 1 inches thick, typically 0.40 to 0.75 inches thick to produce the FRC panel. The process for producing cementitious panels from fiber-slurry mixtures of the present invention produces panels having at most a single layer of fiber reinforced cementitious slurry. Preferably the moving surface moves at a speed of 1 to 100 feet per minute, more preferably 5 to 50 feet per minute. This is substantially faster than extrusion processes.

The resulting fiber-slurry mixtures of the present invention distinguish over cementitious mixtures used in extrusion processes. Such extrusion mixtures have a slump of 0 to 2 inches as measured according to the slump test using a 4 inch tall and 2 inch diameter pipe and have a viscosity greater than 50000 centipoise, more typically greater than 100000 centipoise, and most typically greater than 200000 centipoise. The extrusion mixtures also generally do not include water reducers, plasticizers, and superplasticizers, which are present in fiber-slurry mixtures of the present invention. As mentioned above, plasticizers are commonly manufactured from lignosulfonates, a by-product from the paper industry. Superplasticizers have generally been manufactured from sulfonated naphthalene condensate or sulfonated melamine formaldehyde, or based on polycarboxylic ethers.

A distinctive feature of the mixer and mixing method of the present invention disclosed herein is the ability of this mixer to blend reinforcing fibers with the rest of the cementitious components in a continuous operation without unduly damaging the added fibers. Furthermore, the mixer and mixing method of this invention allow production of a fiber reinforced cementitious slurry mixture having a desirable working consistency. The slurries with favorable rheological properties produced by this mixer can beneficially be utilized for producing products using a variety of manufacturing processes. For instance, a workable slurry consistency facilitates further processing and formation of panel products on a continuous forming line running at high line speeds.

The present invention also provides an apparatus for preparing the above-described composite fiber-slurry mixtures comprising:

a slurry mixer for having a liquid stream inlet and a dry cementitious powder stream inlet for mixing a liquid stream comprising water and a stream of a dry cementitious powder comprising cement, gypsum and aggregate, said slurry mixer having a horizontally or vertically mounted impeller;

a single pass horizontal fiber-slurry continuous mixer;

a conduit for passing the cementitious slurry from the slurry mixer into the single pass horizontal fiber-slurry continuous mixer and a conduit for passing a stream of reinforcement fibers into the horizontal fiber-slurry continuous mixer, a single pass horizontal fiber-slurry continuous mixer for mixing the cementitious slurry and the reinforcement fibers to form a fiber-slurry mixture, the horizontal fiber-slurry continuous mixer comprising an elongated mixing chamber defined by a horizontal (typically cylindrical) housing having an interior side wall, at least one fiber inlet port to introduce reinforcement fibers into the mixing chamber in a first feed section of the horizontal housing, and at least one cementitious slurry inlet port to introduce cementitious slurry mixture into the chamber in a second feed section of the horizontal housing, a fiber-slurry mixture outlet port at a second discharge end section of the horizontal cylindrical housing to discharge the fiber reinforced cementitious slurry mixture produced by the mixer, and a venting port to remove any air introduced into the mixing chamber from raw material feed, a horizontally oriented shaft mounted for rotating in the elongated mixing chamber, the horizontally oriented shaft traversing from one end of the mixer to another, a plurality of mixing and conveying paddles mounted on the horizontally oriented shaft of the mixer at regular intervals and different circumferential locations, the paddles extending radially from a location on the shaft, the paddles comprising a pin engaged to a paddle head, the pin pivotally engaged to the horizontally oriented shaft and/or the paddle head to permit pivotal rotation of the paddle head relative to the respective location on the horizontally oriented shaft, wherein the plurality of paddles are arranged to mix the reinforcement fibers and cementitious slurry and move the cementitious slurry and reinforcement fibers being mixed to the fiber-slurry mixer outlet.

The horizontal fiber-slurry continuous mixer is connected to a drive mechanism and a drive motor to accomplish shaft rotation when the horizontal fiber-slurry continuous mixer is in operation, wherein the horizontally oriented shaft is externally connected to the drive mechanism and the drive motor Preferably the mixing chamber of the horizontal fiber-slurry mixer is adapted and configure to mix the cementitious slurry and fibers in the mixing chamber of the horizontal fiber-slurry mixer for an average mixing residence time of about 5 to about 240 seconds, preferably 10 to 180 seconds, more preferably 10 to 120 seconds, most preferably 10 to 60 seconds while the rotating paddles apply shear force, wherein the central rotating shaft rotates at 30 to 450 RPM, more preferably 40 to 300 RPM, and most preferably 50 to 250 RPM during mixing, to the fiber-slurry mixture to produce a uniform fiber-slurry mixture as described above that has a consistency to allow the fiber-slurry mixture to be discharged from the fiber-slurry mixer.

The mixer of the present invention may be employed as part of an apparatus for producing a cementitious panel having at most a single layer of fiber reinforced cementitious composition which includes a conveyor-type frame supporting a moving web; a first water and cementitious material mixer in operational relationship to the frame and configured for feeding the cementitious slurry into the fiber-slurry mixer; a first slurry feed station (headbox) in operational relationship to the frame and configured for depositing a layer of settable fiber-containing cementitious slurry upon the moving web. Downstream is an apparatus for cutting the set slurry into cement boards.

The method disclosed herein is a continuous method as opposed to a batch method. In a continuous method the raw materials required to make the end product are metered and fed continuously at a rate that equals the rate (mass balance) at which the end product is being produced, that is, the raw material feed flows in the process and the end product flows out of the process simultaneously. In a batch method, the raw materials required to make the end product are first combined in large amounts to prepare a large batch of mixture for storage in appropriate vessel/s; this batch of mixture is then subsequently drawn from the storage vessel/s to produce multiple pieces of the end product.

BRIEF DESCRIPTION OF THE DRAWINGS

FIG. 4 shows a perspective view of a paddle of the horizontal single shaft continuous fiber-slurry mixer embodiment of the present fiber-slurry mixing device of FIG. 3.

FIG. 5 shows a top view of a paddle and a portion of the shaft of the horizontal single shaft continuous fiber-slurry mixer embodiment of the present fiber-slurry mixing device of FIG. 3.

FIG. 14 shows a photograph of a slump patty of a fiber reinforced slurry cementitious mixture made using the fiber-slurry mixer of the present invention.

FIG. 15 is a thickness profile of a ¾" thick panel produced as a single layer on an FRC pilot line using the forming headbox of this invention; No smoothing device or vibrating screed plates were used on the top surface of the cast panel.

In the figures, like reference numerals indicate like elements unless otherwise indicated.

DETAILED DESCRIPTION OF THE INVENTION

Figure 1:
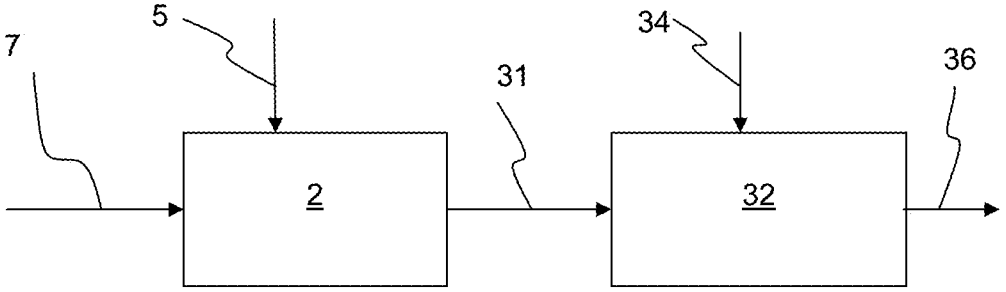
FIG. 1 shows a block flow diagram of the method of the present invention.

FIG. 1 shows a block flow diagram of the mixing portion of the method of the present invention employing a separate slurry mixer and fiber slurry mixer. In the method a stream 5 of dry cementitious powder passes through a first conduit and aqueous medium stream 7 passes through a second conduit to feed a slurry mixer 2 to make cementitious slurry 31. The cementitious slurry 31 passes through a third conduit and a reinforcement fiber stream 34 passes through a fourth conduit to feed a fiber-slurry mixer 32 to make the stream of fiber-slurry mixture 36.

The resulting fiber-slurry mixture is suitable for a variety of uses. For example, the resulting slurry is suitable for being deposited and used as statuary, shotcrete, consolidation of loose rock, soil stabilization, pre-cast concrete products, pavement, repair application, or as a layer on a moving surface of a panel production line uniformly as a layer 0.125 to 2 inches thick, preferably 0.25 to 1 inches thick, typically 0.40 to 0.75 inches thick on the moving surface of the panel production line to produce a fiber reinforced concrete (FRC) panel. The resulting fiber-slurry mixture has a viscosity less than 45000 centipoise, more preferably less than 30000 centipoise, and most preferably less than 15000 centipoise. Typically the resulting fiber-slurry mixtures have a viscosity of at least 1500 centipoise. The resulting fiber-slurry mixture also has a slump according to the slump test using a 4 inch tall 2 inch diameter pipe is from 4 to 11 inches. The resulting fiber-slurry mixture is not suitable for extrusion manufacturing processes that typically rely on slurry mixture compositions have extremely high viscosity.

The slump test characterizes the slump and flow behavior of the cementitious compositions produced by the method and apparatus of this invention. The slump test used herein utilizes a hollow cylinder about 5.08 cm. (2 in.) diameter and about 10.16 cm. (4 in.) length held vertically with one open end resting on a smooth plastic surface. The cylinder is filled up to the top with the cementitious mixture followed by striking off the top surface to remove the excess slurry mixture. The cylinder is then gently lifted up vertically to allow the slurry to come out from the bottom and spread on the plastic surface to form a circular patty. The diameter of the patty is then measured and recorded as the slump of the material. As used herein, compositions with good flow behavior yield a larger slump value.

Slurry Mixer

Any of a variety of continuous or batch mixers may be employed as the slurry mixer 2. For example, the mortar mixers described in ICRI Guideline No. 320.5R-2014, Technical Guidelines, Pictorial Atlas of Concrete Repair Equipment, International Concrete Repair Institute, May 2014, incorporated by reference, can be used in this invention for preparing cementitious slurry 31. These include horizontal shaft mixers, tumble mortar mixers, rotating-drum stationary mixers, pan-type mixers, rotating-tub rotating paddle mixers, planetary paddle mixers, horizontal shaft mixer-pump combinations, and vertical shaft mixer-pump combinations. The horizontal shaft mixer-pump combinations and vertical shaft mixer-pump combinations are continuous mixers. In addition, continuous slurry mixers disclosed in U.S. Pat. No. 7,513,963 B2 to George et al, incorporated by reference, may also be used in the present invention. Continuous slurry mixers disclosed in US Pat. No. 7347895 to Dubey (column 6, lines 36 to 56), incorporated by reference, may also be used to prepare slurry in a continuous manner.

Figure 2:
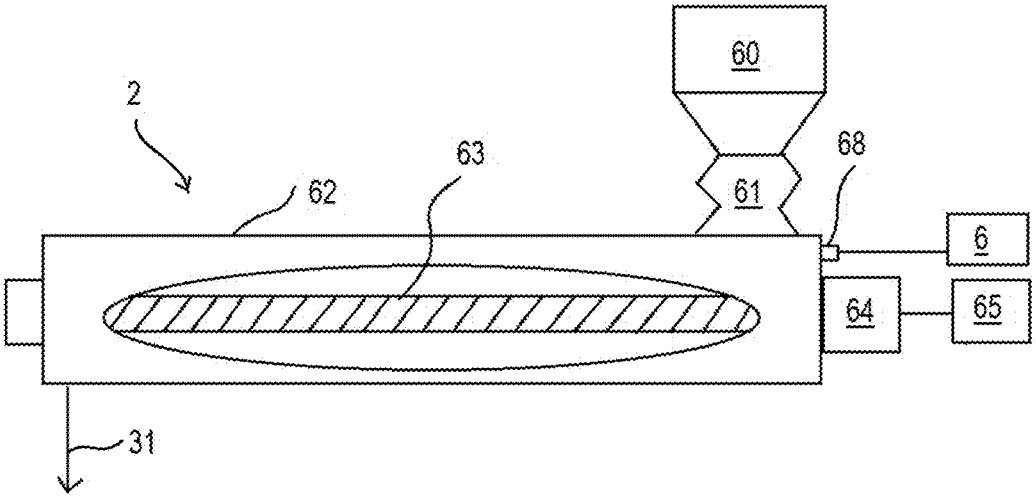
FIG. 2 is a cementitious slurry mixer.

Slurry mixer 2 is preferably a continuous slurry mixer. For example, the continuous slurry mixer 2 may be a single shaft or dual shaft horizontal mixer. FIG. 2 schematically shows an exemplary continuous slurry mixer 2, specifically, a single shaft horizontal mixer 2.

The term horizontal when used with mixers means generally horizontal. Thus, a mixer oriented with a variation of plus or minus 20 degrees from horizontal would still be considered a horizontal mixer.

FIG. 2 shows a powder mixture of cementitious materials such as Portland cement, aggregate, fillers, etc. is fed to the slurry mixer 2 from a dry powder feeder (not shown) to typically an overhead hopper bin 60 and then passes through a bellows 61 into a horizontal chamber 62 which contains a shaft 63. At least part of the shaft 63 is an auger screw. FIG. 2 shows the entire shaft 63 provided with an auger. However, preferably only a part of shaft 63 is an auger to move the cementitious powder. The remainder of the shaft 63 is preferably provided with mechanical components (such as paddles, not shown) to mix dry powder with water and other additives to prepare cementitious slurry. Preferably an upstream portion of the shaft 63 (for example the upstream 20 to 60% of the shaft length) has the auger and the remainder downstream portion of the shaft has the paddles. Shaft 63 is driven by a side mounted motor 64 that is regulated by a speed controller 65. The solids may be fed from the hopper bin 60 to the auger screw of shaft 63 by a volumetric feeder or a gravimetric feeder (not shown). The amount of dry powder fed into the slurry mixer 2 is provided by a separate dry powder feeder, which may be operated volumetrically or gravimetrically.

Volumetric feeding systems would discharge powder from the storage hopper bin 60 at a constant rate (volume per unit time, e.g., cubic feet per minute). Gravimetric feeding systems generally use a volumetric feeder associated with a weighing system to control the discharge of powder from the storage hopper bin 60 at a constant weight per unit of time, e.g., pounds per minute. The weight signal is used via a feedback control system to constantly monitor the actual feed rate and compensate for variations in bulk density, porosity, etc.

Aqueous medium, such as water, from liquid pump 6 feeds the horizontal chamber 62 through a nozzle 68. The cementitious powder and water slurry mixture 31 is then discharged from the horizontal chamber 62 and then feeds the fiber-slurry mixer 32 of FIG. 1.

Horizontal Fiber-Slurry Continuous Mixer

The fiber-slurry continuous mixer of the present invention preferably achieves the following results:

Allows continuous blending of fibers with the rest of the cementitious components to produce a uniformly mixed fiber reinforced cementitious slurry mixture.

Reduces the required mixing time from several minutes to less than 60 seconds, preferably less than 30 seconds, to produce a uniformly blended fiber reinforced cementitious slurry mixture. Generally the chamber provides an average slurry residence time of about 5 to about 240 seconds, preferably 10 to 180 seconds, more preferably 10 to 120 seconds, most preferably 10 to 60 seconds, typically 20 to 60 seconds.

Does not cause fiber balling and lumping during the mixing operation.

Does not cause damage to the reinforcing fibers as a result of the mixing action.

Allows use of rapid setting cementitious materials useful in manufacturing and construction applications.

The horizontal fiber-slurry continuous mixer disclosed as part of this invention comprises:

an elongated mixing chamber defined by a horizontal (typically cylindrical) housing having an interior side wall, a central rotating shaft mounted in the elongated mixing chamber traversing from one end of the mixer to another, wherein the central shaft is externally connected to a drive mechanism and an drive motor, for example, powered by electricity, fuel gas, gasoline, or other hydrocarbon, to accomplish shaft rotation when the mixer is in operation;

a plurality of mixing and conveying paddles mounted on the central shaft of the mixer at regular intervals and different circumferential locations, the paddles extending radially from a location on the central shaft, the paddles comprising a pin having a paddle head, the pin pivotally engaged to the shaft and/or the paddle head pivotally engaged to the pin to permit pivotal rotation of the paddle relative to the respective location on the shaft, wherein the plurality of paddles are arranged to mix the cementitious slurry and move the cementitious slurry and reinforcement fibers being mixed to the fiber-slurry mixture outlet, at least one fiber inlet port to introduce reinforcement fibers into the chamber in a first feed section of the horizontal housing;

at least one cementitious slurry inlet port to introduce cementitious slurry mixture into the chamber in the feed section of the horizontal housing;

a fiber-slurry mixture outlet port at a second discharge end section of the horizontal cylindrical housing to discharge the fiber reinforced cementitious slurry mixture produced by the mixer, and a venting port to remove any air introduced into the mixing chamber from raw material feed.

The fiber-slurry mixer can have additional inlet ports to introduce other raw materials or other performance enhancing additives into the mixing chamber.

The cementitious slurry and fibers are mixed in the mixing chamber of the horizontal fiber-slurry mixer for an average mixing residence time of about 5 to about 240 seconds, preferably 10 to 180 seconds, more preferably 10 to 120 seconds, most preferably 10 to 60 seconds while the rotating paddles apply shear force, wherein the central rotating shaft rotates at 30 to 450 RPM, more preferably 40 to 300 RPM, and most preferably 50 to 250 RPM during mixing, to the fiber-slurry mixture, wherein the fiber-slurry mixture discharged from the mixer has a slump of 4 to 11 inches, preferably 6 to 10 inches, as measured according to a slump test using a 4 inch tall and 2 inch diameter pipe and a viscosity less than 45000 centipoise, preferably less than 30000 centipoise, and more preferably less than 15000 centipoise. The resulting fiber-slurry mixture also has a slump according to the slump test using a 4 inch tall 2 inch diameter pipe is from 4 to 11 inches. The resulting fiber-slurry mixture is not suitable for extrusion manufacturing processes that typically rely on slurry mixture compositions have extremely high viscosity. The resulting fiber-slurry mixture is a uniform fiber-slurry mixture that has a consistency that will allow the fiber-slurry mixture to be discharged from the horizontal fiber-slurry mixer and be suitable for being deposited as a continuous layer on a moving surface of a panel production line uniformly as a layer 0.25 to 2.00 inches thick, preferably 0.25 to 1 inches thick, more preferably 0.4 to 0.8 inches thick, typically 0.5 to 0.75 inches thick on the moving surface of the panel production line to produce a FRC panel. Typically the fiber-slurry mixture is deposited at a rate of about 0.10-25 cubic feet per minute for a panel 4 to 8 feet wide. This is faster than conventional extrusion manufacturing processes that utilize extremely viscous slurries to facilitate product formation as the viscous slurry is extruded through a die to for product shape. Extrusion manufacturing processes are typically used to form three-dimensional hollow-shaped thin-walled articles where the high slurry viscosity is useful in holding product shape during and after material extrusion.

The central shaft is externally connected to a drive mechanism and a drive motor, for example, powered by electricity, fuel gas, gasoline, or other hydrocarbon, to accomplish shaft rotation when the mixer is in operation. Typically an electrical motor and drive mechanism will drive the central shaft in the mixing chamber.

A distinctive feature of the mixer and mixing method disclosed herein is the ability of this mixer to blend reinforcing fibers with the rest of the cementitious components in a continuous operation without unduly damaging the added fibers. Furthermore, the mixer and mixing method of this invention allow production of a fiber reinforced cementitious slurry mixture having a desirable working consistency. The slurries with favorable rheological properties produced by this mixer can beneficially be utilized for producing products using a variety of manufacturing processes. For instance, a workable slurry consistency facilitates further processing and formation of panel products on a continuous forming line running at high line speeds.

Figure 3:
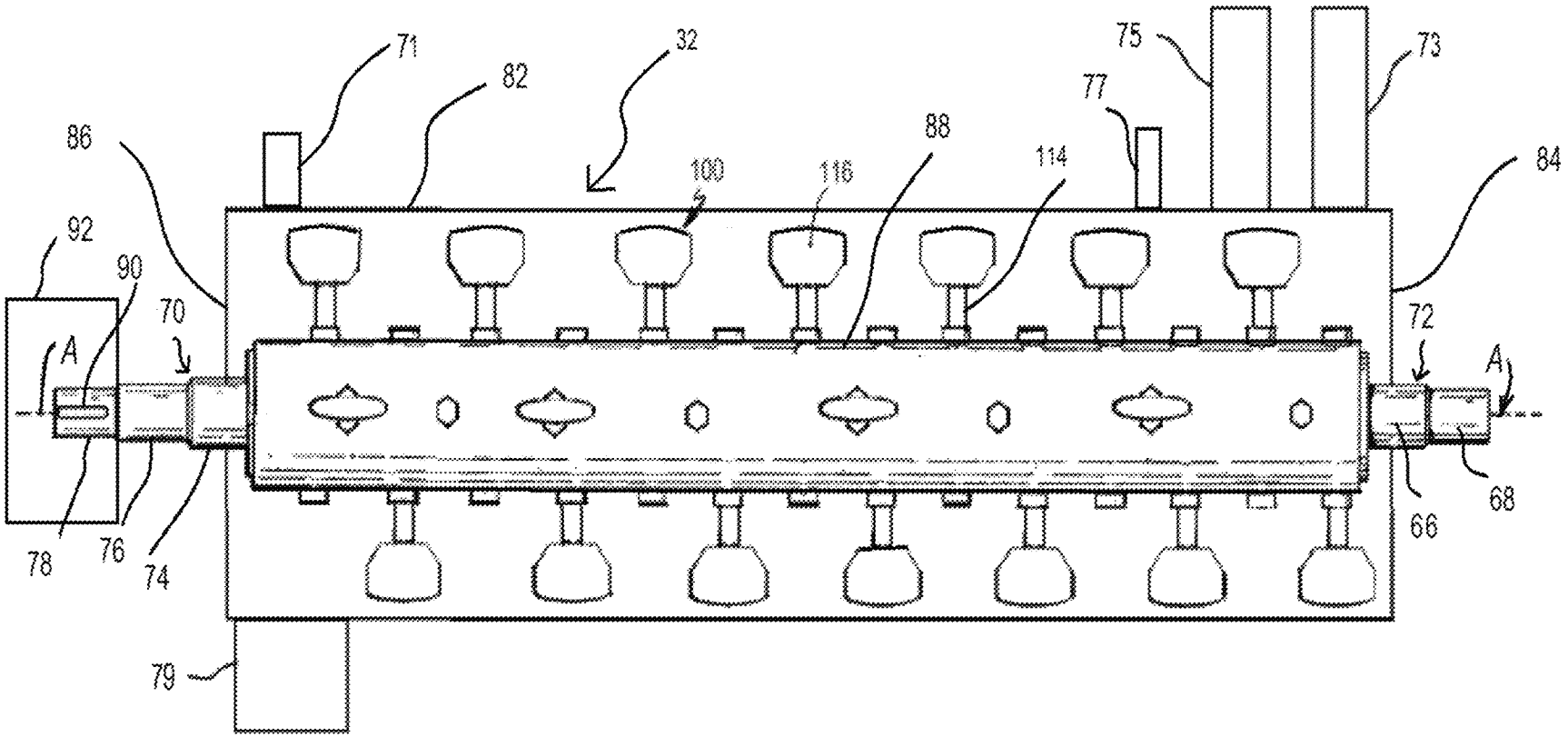
FIG. 3 shows a diagrammatic elevational view of a horizontal single shaft continuous fiber-slurry mixer embodiment of the present fiber-slurry mixing device.

FIG. 3 shows a schematic drawing of an embodiment of the fiber-slurry mixer 32. The shaft 88 and paddles 100. Each paddle 100 has a pin 114 and a broad paddle head 116 that extends transverse relative to the pin 114. Preferably the fiber-slurry mixer 2 is a single shaft mixer.

As depicted in FIG. 3, the embodiment of the horizontal fiber-cementitious slurry mixer 32 comprises an elongated mixing chamber comprising cylindrical horizontal sidewalls 82, a first end wall 84 of a feed section of the mixer 32, a second end wall 86 of a discharge section of the mixer 32. The horizontal fiber-cementitious slurry mixer 32 also comprises a central rotatable shaft 88, a cementitious slurry inlet 73, a reinforcement fiber inlet 75, and a fiber-slurry mixture discharge outlet 79. Mixing and conveying paddles 100 extending from the central rotatable shaft 88. The horizontal fiber-cementitious slurry mixer 32 also comprises other inlet ports 77, one shown, to feed other raw materials and performance enhancing additives into the mixer. The horizontal fiber-cementitious slurry mixer 32 also comprises a venting port 71 to remove any air introduced into the mixing chamber from raw material feed. The horizontal fiber-cementitious slurry mixer 32 also comprises an electrical motor and drive mechanism 92 to drive the central shaft in the mixing chamber.

The rotatable shaft 88 rotates about its longitudinal axis "A" to mix the fed ingredients and convey them as fiber-slurry mixture to the discharge outlet 79.

The reinforcement fibers and cementitious slurry and other ingredients will be feed to the mixer 32 at respective rates to leave an open space in the mixer above resulting mixture to facilitate mixing and conveying. If desired, a liquid level control sensor is used to measure the level of the slurry in the horizontal chamber of the mixer.

The rotatable shaft 88 may include a first end assembly 70 and a second end assembly 72. First end assembly 70 and second end assembly 72 may take any of a wide variety of forms known to one of skill in the art. For example, first end assembly 70 may include a first end engagement portion that operatively engages a first end of the rotatable shaft 88, a first cylindrical proportion 74 extending from the first end engagement portion, an intermediate cylindrical portion 76 extending from the first cylindrical portion 74, and an end cylindrical portion 78 extending from the intermediate cylindrical portion 76 and including a slot 90. The second end assembly 72 may include a second end engagement portion that operatively engages a second end of the rotatable shaft 88, a first cylindrical portion 66 extending from the second end engagement portion, and an end cylindrical portion 68 extending from the first cylindrical portion 66. In at least one embodiment, first end engagement portion of first end assembly 70 may be engaged to the rotatable shaft 88 proximate to first cylindrical proportion 74. In one or more embodiments, end cylindrical portion 78 may be operatively engaged to the electrical motor and drive mechanism 92 capable of imparting rotation (e.g., high-speed rotation) to rotatable shaft 88 and the one or more paddle assemblies 100 engaged therewith to mix the reinforcement fibers and cementitious slurry. Second end engagement portion of second end assembly 72 may be engaged to a second end (e.g., an end opposing the first end) of rotatable shaft 88 proximate to first cylindrical portion 66. End cylindrical portion 68 of second end assembly 72 may be preferably engaged to a bearing assembly, which may be integral to an exterior wall of the horizontal fiber-cementitious slurry mixer 32, to permit the rotation of rotatable shaft 88.

As may be seen in FIG. 3, a plurality of paddle assemblies 100 may be permanently and/or removably engaged (e.g., affixed, adhered, connected, etc.) to rotatable shaft 88 and configured into, for example, aligned rows and/or columns (e.g., rows along the length of the rotatable shaft 88, columns around the circumference of the rotatable shaft 88). The paddle assemblies 100 may be permanently or releasably engaged to rotatable shaft 88in offset rows or columns as desired. In addition, rotating shaft 88 may accommodate any arrangement or configuration of paddle assemblies 100 as desired, preferably but not limited to spiral and/or helical configurations.

The rotatable shaft 88, may be constructed to rotate at a predetermined rate of 30 to 450 RPM, more preferably 40 to 300 RPM, and most preferably 50 to 150 RPM during mixing.

Paddle pin 114 has a width W1 which is less than a width W2 of paddle head 116 (See FIG. 4). Pin 114 of mixing and conveying paddle 100 may include a threaded end portion 115 (See FIG. 4) adapted for engagement into a threaded opening of the rotatable shaft 88, such that mixing and conveying paddle 100 may be rotated to achieve a desired or selected pitch (e.g., angle) relative to the rotatable shaft 88. If desired, each mixing and conveying paddle 100 may be rotated a desired distance into the rotatable shaft 88, wherein the distance may be the same or different from one or more other paddle assemblies or sections of paddle assembles as engaged to the rotatable shaft 88.

The above mentioned features and parameters of the fiber-slurry continuous mixer of this invention are further described as follows:

Elongated Mixing Chamber

The elongated mixing chamber is typically cylindrical in shape.

The length of the mixing chamber typically ranges anywhere from about 2 to 8 feet. The preferred length of the mixing chamber is from about 3 to 5 feet.

The diameter of the mixing chamber typically ranges anywhere from about 4 to 24 inches. The preferred diameter of the mixing chamber ranges from about 6 to 12 inches.

Central Rotating Shaft

The central rotating shaft diameter is typically from about 1 to 8 inches. The preferred central shaft diameter ranges from about 2 to 6 inches.

The central rotating shaft rotates at a speed, preferably ranging from about 30 to 450 RPM, more preferably ranging from about 40 to 300 RPM, further more preferably ranging from about 50 to 250 RPM, and most preferably ranging from about 50 and 150 RPM. It has been discovered that relatively lower mixer speeds are preferable to meet the objectives of the present invention. It has been surprisingly found that excellent fiber dispersion in the cementitious slurry mixture can be obtained even at relatively low mixer speeds. Furthermore, another important benefit of using lower mixing speeds is that it results in reduced fiber breakage and superior material working and flow properties useful in further processing of the fiber reinforced cementitious slurry mixture.

A variable frequency drive is preferably used with the mixer for turning the central rotating shaft when the mixer is in the operational mode. The variable frequency drive is helpful for adjusting and fine-tuning the mixer speed for a given combination of raw materials involved in the production process.

The continuous mixers of the present invention can either be a single-shaft mixer, a dual-shaft mixer, or a multi-shaft mixer. This disclosure describes the single-shaft mixers of the present invention in greater detail. However, it is contemplated that dual-shaft or multiple-shaft mixers in accordance to the present invention can also be beneficially employed for producing fiber reinforced cementitious slurry mixtures possessing desirable properties that are useful in a variety of applications including continuous production processes.

Mixing and Conveying Paddles

The mixing and conveying paddles 100 mounted on the central shaft can have different shapes and dimensions to facilitate mixing and conveying of the added components in the mixer. The mixing and conveying paddles include paddles with a pin and a relatively wider head to help move the material forward. In addition to the paddles having one type of pin and head, the fiber-slurry mixer may include more than one type of paddle having a pin and a relatively wider head, or just pins, to achieve desirable characteristics for further processing of the material. However, as seen in FIG. 3 the invention may employ a single style paddle. The overall dimensions of the paddles are such that the clearance (space) between the inner circumference of the mixer chamber and the paddle's furthermost point from the central shaft is preferably less than ¼", more preferably less than ⅛", and most preferably less than 1/16". Too great a distance between the paddle tips and the inner walls of the chamber would result in slurry build-up. The paddles may be attached to the central shaft using different means including threaded attachment (as shown) and/or welding attachment (not shown).

The quality of mixing and conveying of the components in the mixer is also dictated by the orientation of the paddles in the mixer. A parallel or perpendicular paddle orientation with respect to the cross-section of the central shaft diminishes the conveying action of the paddles thus increasing the residence time of the material in the mixer. An increased residence time of the material in the mixer can lead to significant fiber damage and production of fiber reinforced cementitious slurry mixture having undesirable characteristics. The orientation of the longitudinal axis "LH" of the paddle head 116 with respect to the longitudinal axis "A" of the central shaft 88 is preferably at an angle "B" (FIG. 5) from about 10° to 80°, more preferably from about 15° to 70°, and most preferably from about 20° to 60°. The use of preferred paddle orientation leads to a more efficient mixing and conveying action of the slurry mixture and also causes minimal damage to the reinforcing fibers in the mixer.

The set of paddles in the mixer are typically configured in a spiral form on the central shaft from one end of the mixer to another. This arrangement of paddles further facilitates conveying action of the material inside the mixer. Other configurations of paddle arrangement in the mixer are possible and are contemplated as part of this invention.

The paddles can be made of variety of materials including metals, ceramics, plastics, rubber, or a combination thereof. Paddles with softer lining materials are also contemplated as they tend to minimize material and fiber breakage.

The paddles and/or inner walls of the elongated mixing chamber may be coated with a release material, to minimize buildup of the cementitious slurry on the paddles and/or shell.

Figure 6:
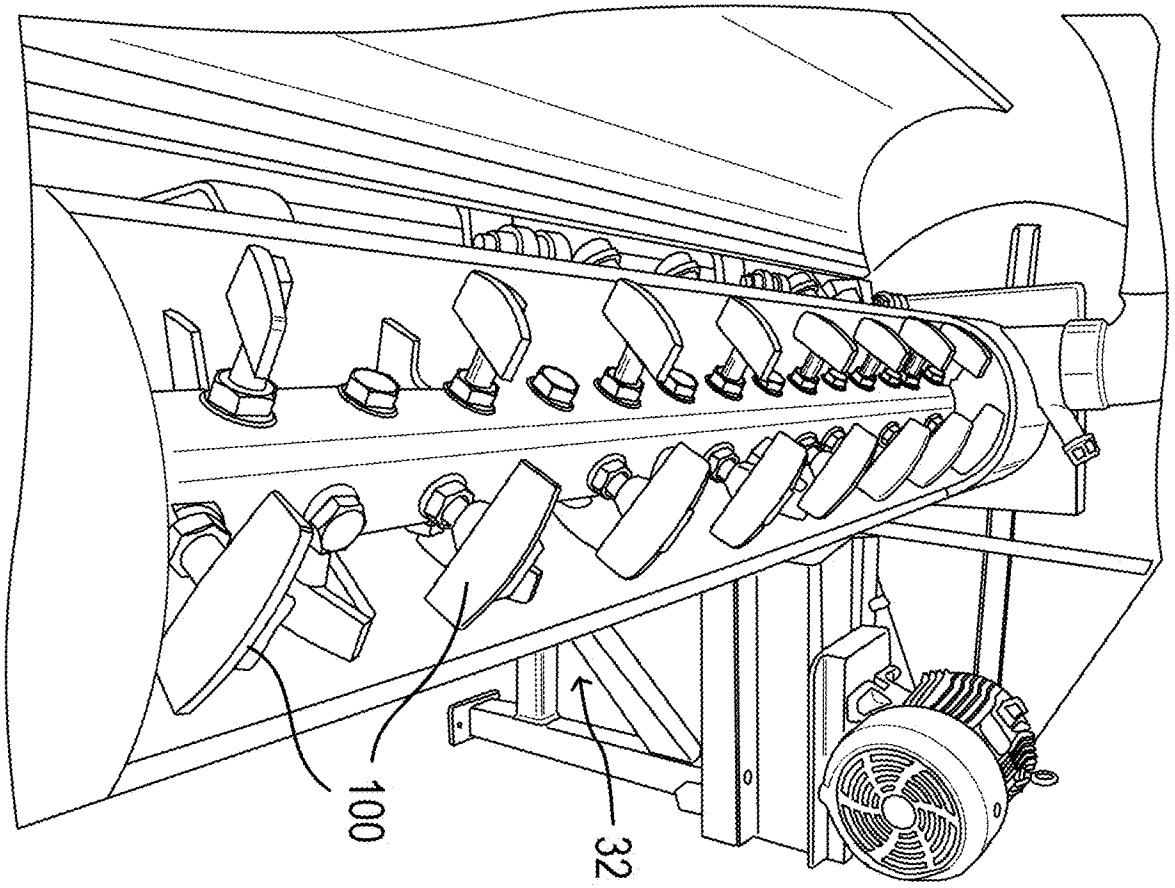
FIG. 6 shows a portion of the horizontal single shaft continuous fiber-slurry mixer embodiment of the present fiber-slurry mixing device of FIG. 3 in an open position.
Figure 7:
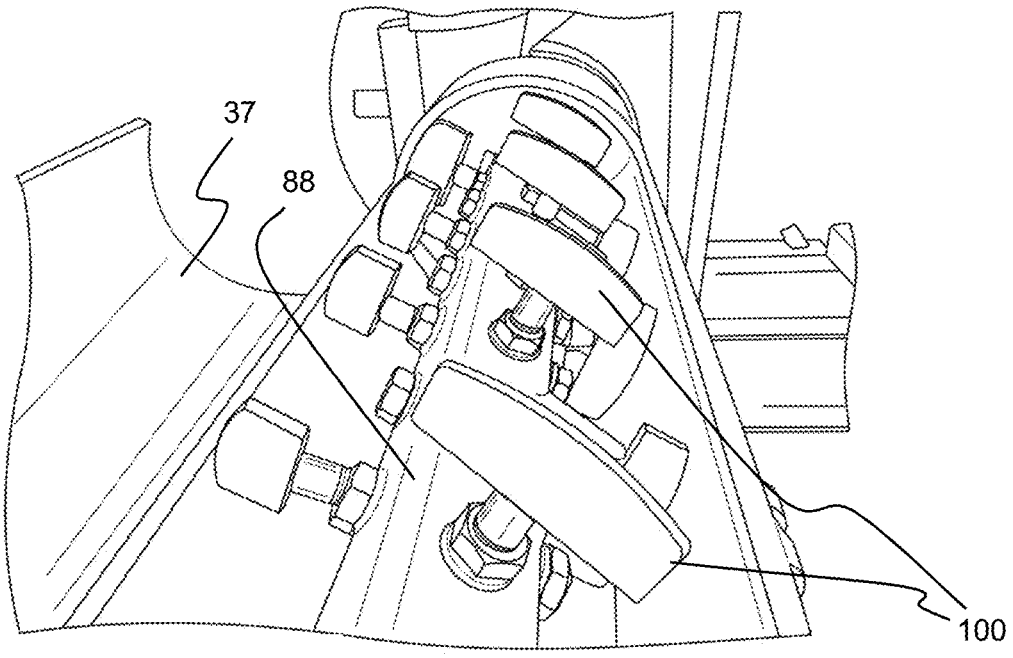
FIG. 7 shows a portion of the horizontal single shaft continuous fiber-slurry mixer embodiment of the present fiber-slurry mixing device of FIG. 3 in an open position.
Figure 8:
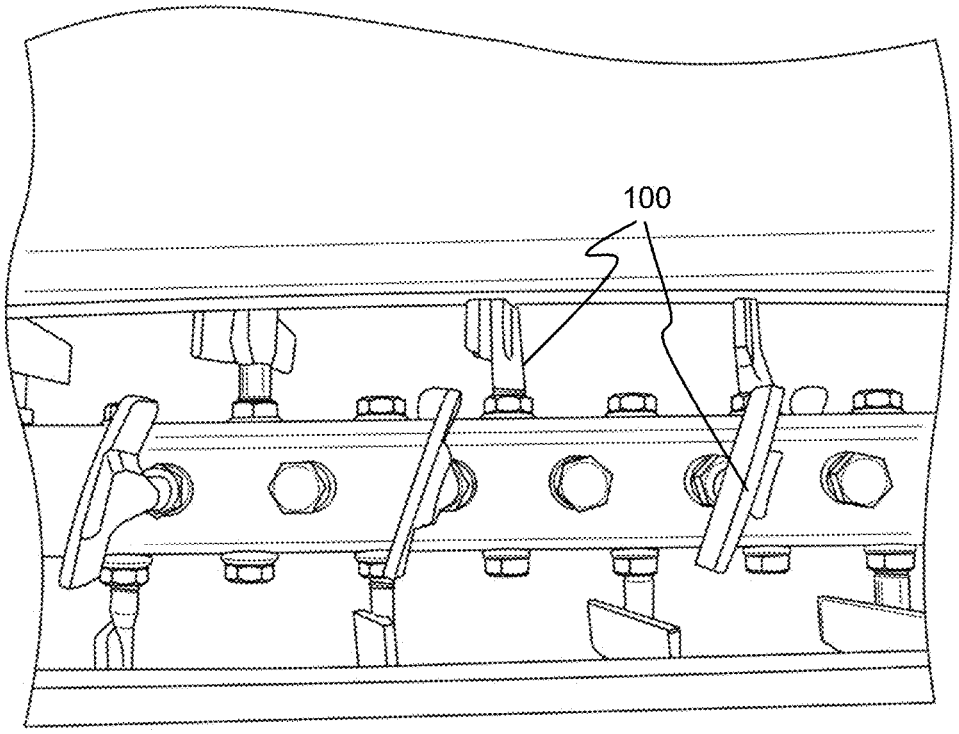
FIG. 8 shows a portion of the horizontal single shaft continuous fiber-slurry mixer embodiment of the present fiber-slurry mixing device of FIG. 3 in an open position.

FIGS. 6-8 show portions of the fiber-slurry mixer 32 with a door 37 of its mixing chamber in an open position to show views of the paddles 100 mounted on the shaft 88 by being threaded into the shaft 88.

FIG. 7 depicts four linear rows of paddles in the mixer in this particular embodiment of mixer configuration.

FIG. 8 provides a close-up view of the mixer showing the orientation of the paddles 100 with respect to the central shaft 88. Placement of the paddles 100 on the central shaft 88 in the spiral form can also be observed.

Inlet Ports

The size, location, and orientation of raw material inlets ports (inlet conduits) of the fiber-slurry mixer are configured to ease introduction of the raw material into the fiber-slurry mixer and to minimize potential for blocking of ports from the slurry mixture in the mixer.

The cementitious slurry from the slurry mixer is preferably conveyed using a slurry hose to the fiber-slurry mixer and introduced into the fiber-slurry mixer through an inlet port setup to accept the slurry hose. Alternatively, the cementitious slurry from the slurry mixer may be gravity fed to the fiber-slurry mixer.

The fibers can be introduced into the fiber-slurry mixer gravimetrically or volumetrically using a variety of metering equipment such as screw feeders or vibratory feeders. Fibers can be conveyed from a fiber feeder to the fiber-slurry mixer by a variety of conveying devices. For example, fibers can be transferred using screws (augers), air conveying, or simple gravity deposition. Discrete or chopped fibers can be made of different reinforcing fiber materials including fiberglass; polymeric materials such as polypropylene, polyethylene, polyvinyl alcohol, etc.; carbon; graphite; aramid; ceramic; steel; cellulosic, paper, or natural fibers such as jute or sisal; or a combination thereof. The fiber length is about 2 inches or lower, more preferably less than 1.5 inches or lower and most preferably less than 0.75 inches or lower.

Figure 9:
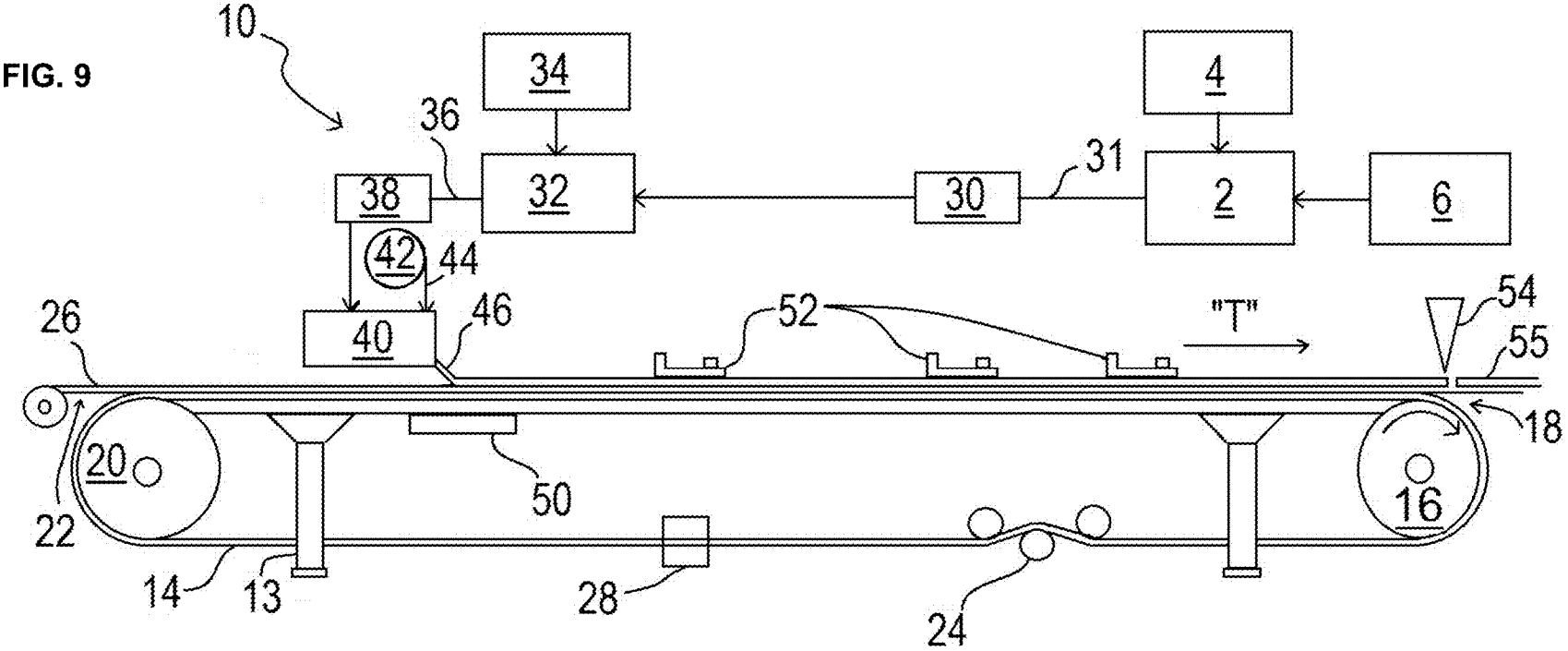
FIG. 9 is a diagrammatic elevational view of a cementitious panel (FRC panel) production line suitable for use with the present fiber-slurry mixing device, for example the fiber-slurry mixing device of FIG. 3.
Figure 10:
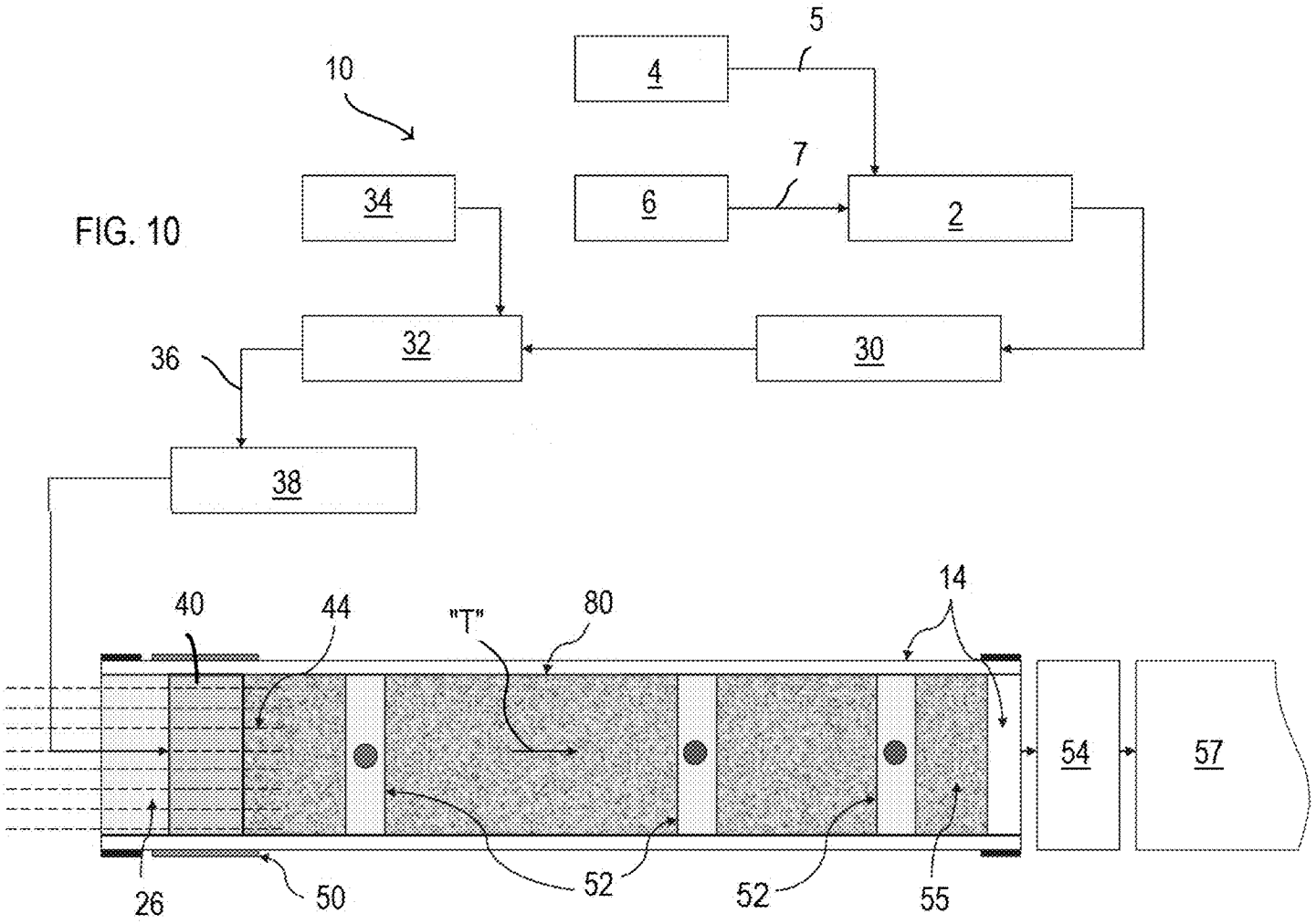
FIG. 10 shows the cementitious panel production line of FIG. 9 as a composite view of a process flow chart for the portion of the cementitious panel production line upstream of the forming assembly (headbox) and a top view of the cementitious panel production line downstream of the forming assembly (headbox).

Panel Production Using the Fiber-Slurry Mixture from the Slurry Mixer and Fiber-Slurry Mixer System FIGS. 9 and 10 show the fiber-slurry mixture is in panel production. A cementitious panel production line is diagrammatically shown and is generally designated 10. The production line 10 includes a support frame or forming table 12 having a plurality of legs 13 or other supports. Included on the support frame 12 is a moving carrier 14, such as an endless rubber-like conveyor belt with a smooth, water-impervious surface, however porous surfaces are contemplated. As is well known in the art, the support frame 12 may be made of at least one table-like segment, which may include designated legs 13 or other support structure. The support frame 12 also includes a main drive roll 16 at a distal end 18 of the frame 12, and an idler roll 20 at a proximal end 22 of the frame 12. Also, at least one belt tracking and/or tensioning device 24 is typically provided for maintaining a desired tension and positioning of the carrier 14 upon the rolls 16, 20. In this embodiment, the cementitious panels are produced continuously as the moving carrier proceeds in a direction "T" from the proximal end 22 to the distal end 18.

In this embodiment, a web 26 of release paper, polymer film, a plastic carrier, slip sheet, or forming mold, for supporting a slurry prior to setting, may be provided and laid upon the carrier 14 to protect it and/or keep it clean. However, it is also contemplated that, rather than the continuous web 26, individual sheets (not shown) of a relatively rigid material, e.g., sheets of polymer plastic, may be placed on the carrier 14. These carrier films or sheets may be removed from the produced panels at the end of the line or they may be incorporated as a permanent feature in the panel as part of the overall composite design. When these films or sheets are incorporated as a permanent feature in the panel they may provide enhanced attributes to the panel including improved aesthetics, enhanced tensile and flexural strengths, enhanced impact and blast resistance, enhanced environmental durability such as resistance to water and water vapor transmission, freeze-thaw resistance, salt-scaling resistance, and chemical resistance.

Continuous reinforcement 44 such as a roving or a web of reinforcing scrim such as fiberglass scrim may be provided for embedding in the fiber-slurry mixture prior to setting and reinforcing the resulting cementitious panels. The continuous rovings and/or reinforcing scrim roll 42 are fed through the headbox 40 to be laid upon the mixture on the carrier 14. However, it is also contemplated to not employ the continuous reinforcement 44. The continuous scrim or rovings can be made of different reinforcing fiber materials including fiberglass; polymeric materials such as polypropylene, polyethylene, polyvinyl alcohol, etc; carbon; graphite; aramid; ceramic; steel; cellulosic or natural fibers such as jute or sisal; or a combination thereof. A roving is an assemblage of continuous reinforcing monofilaments. Scrim is a web of continuous fibers running in the machine direction and the cross-direction. Reinforcement may also be provided as a nonwoven fiber web made of discrete reinforcement fibers. The nonwoven fiber web may be made of organic fibers such as polyolefin fibers or inorganic fibers such or fiberglass or a combination thereof. Fibrous webs made of metal fibers are also contemplated as part of the present invention.

It is also contemplated to form the cementitious panels produced by the present line 10 directly upon the carrier 14. In this situation, at least one belt washing unit 28 is provided. The carrier 14 is moved along the support frame 12 by a combination of motors, pulleys, belts or chains which drive the main drive roll 16 as is known in the art. It is contemplated that the speed of the carrier 14 (forming belt) of the forming line may vary to suit the product being made. The fiber-slurry mixture travels in direction "T".

The present production line 10 includes a continuous slurry mixer 2. The slurry mixer may be a single shaft or dual shaft mixer. Dry powder feeder 4 (one or more may be employed) feeds dry components of the cementitious composition, except for reinforcing fibers, to the slurry mixer 2. Liquid pump 6 (one or more may be employed) feeds to the slurry mixer 2 aqueous medium, such as water, with liquid or water soluble additives. The slurry mixer 2 mixes the dry components and the aqueous medium to form a cementitious slurry 31. The cementitious slurry 31 feeds a first slurry accumulator and positive displacement pump 30 which pumps the slurry to a fiber-slurry mixer 32. A fiber feeder 34 (one or more may be employed) feeds fibers to the fiber-slurry mixer 32. Thus, in the fiber-slurry mixer 32 the fibers and slurry are mixed to form a fiber-slurry mixture 36. Fiber-slurry mixture 36 feeds a second slurry accumulator and positive displacement pump 38 which pumps the fiber-slurry mixture 36 to a headbox 40.

Headbox 40 deposits the fiber-slurry mixture on the web 26 of release paper (if present) and/or, if present, continuous reinforcement provided by rovings and/or scrim, traveling on the moving carrier 14. Continuous reinforcement in form of rovings or scrim or nonwoven fiber mat may be deposited on either one or both surfaces of the panel. If desired, continuous reinforcement 44 provided by fiber rovings or spools and/or scrim roll and/or nonwoven fiber mat 42 is also passed through the headbox 40 as shown in FIG. 9 to deposit on top of the deposited fiber-slurry mixture 46. Bottom continuous reinforcement, if desired, is fed behind the headbox 40 and it rests directly on top of the conveying/forming belt. The bottom continuous reinforcement passes under the headbox 40 and the fiber-slurry mixture in the headbox 40 is poured directly on its top as the continuous reinforcement moves forward. For example, continuous reinforcement can be provided by web 26 or a roll (not shown) upstream to the headbox 40 in addition to the roll providing web 26 to lay the continuous reinforcement above web 26. To assist in leveling the fiber-slurry mixture 46 a forming vibrating plate 50 may be provided under or slightly downstream on the location where the headbox 40 deposits the fiber-slurry mixture 46.

The slurry 46 sets as it travels along the moving carrier 14. To assist in leveling the fiber-slurry mixture 46 as the slurry 46 is setting the slurry 46 passes under one or more vibrating screed plates 52. At the distal end 18 of the support frame 12 a cutter 54 (panel cutting device) cuts the set slurry into boards 55. The boards (FRC panels) 55 are then placed on an unloading and curing rack 57 (See FIG. 10) and allowed to cure. Thus, the panel 55 is formed directly on the forming belt 14 or optional release paper/slip sheets/forming molds/nonwoven fiber webs 26.

FIG. 10 further shows edge formation and leakage prevention devices 80. These are edge belts, edge rails or other suitable edge formation and leakage prevention devices as explained elsewhere in this specification, for example belt-bonded slit formers, used singly or in combination.

The fiber-cement mixtures produced by the method and apparatus of this invention contain cement, water, and other cement additives. However, to achieve the desired viscosity the cementitious compositions preferably avoid thickeners or other high viscosity processing aids at high dosage rates as commonly used with conventional fiber cement extrusion processes. For example, the present slurries avoid high viscosity cellulose ethers addition at high dosage rates. Examples of high viscosity cellulose ethers which the present slurries avoid are methyl cellulose, hydroxypropyl methyl cellulose, and hydroxyethyl methylcellulose.

The fiber-cement mixtures produced by the method and apparatus of this invention are aqueous slurries which may be from a variety of settable cementitious slurries. For example, compositions based on hydraulic cements. ASTM defines "hydraulic cement" as follows: a cement that sets and hardens by chemical interaction with water and is capable of doing so under water. Examples of suitable hydraulic cements are Portland cement, calcium aluminate cements (CAC), calcium sulfoaluminate cements (CSA), geopolymers, magnesium oxychloride cements (sorel cements), and magnesium phosphate cements. A preferred geopolymer is based on chemical activation of Class C fly ash.

While calcium sulfate hemihydrate sets and hardens by chemical interaction with water, it is not included within the broad definition of hydraulic cements in the context of this invention. However, calcium sulfate hemihydrate may be included in fiber-cement mixtures produced by the method and apparatus of this invention. Thus, also such aqueous slurries may be based on calcium sulfate cements such as gypsum cements or plaster of Paris. Gypsum cements are primarily calcined gypsum (calcium sulfate hemihydrate). It is customary in the industry to term calcined gypsum cements as gypsum cements.

The fiber-cement mixtures contain sufficient water to achieve the desired slump test value and viscosity in combination with the other ingredients of the fiber-cement mixtures. If desired the composition may have a weight ratio of water-to-reactive powder of 0.20/1 to 0.90/1, preferably 0.20/1 to 0.70/1.

The fiber-cement mixtures may contain pozzolanic material such as silica fume, a finely divided amorphous silica which is the product of silicon metal and ferro-silicon alloy manufacture. Characteristically, it has very high silica content and low alumina content. Various other natural and man-made materials have been referred to as having pozzolanic properties, including pumice, perlite, diatomaceous earth, tuff, trass, metakaolin, microsilica, and ground granulated blast furnace slag. Fly ash also has pozzolanic properties. The fiber-cement mixtures may contain Ceramic microspheres and/or Polymer microspheres.

However, one use of the fiber-cement slurries made by the present method is to produce structural cement panels (SCP panels) having reinforcing fibers such as fiberglass, particularly alkali resistant glass fibers. As such, the cementitious slurry 31 is preferably comprised of varying amounts of Portland cement, gypsum, aggregate, water, accelerators, plasticizers, superplasticizers, foaming agents, fillers and/or other ingredients well known in the art, and described in the patents listed below which have been incorporated by reference. The relative amounts of these ingredients, including the elimination of some of the above or the addition of others, may vary to suit the intended use of the final product.

Water reducing admixture additives optionally can be included in the fiber-cement mixture, such as, for example, superplasticizer, to improve the fluidity of a hydraulic slurry. Such additives disperse the molecules in solution so they move more easily relative to each other, thereby improving the flowability of the entire slurry. Sulfonated melamines and sulfonated naphthalenes, and polycarboxylate based superplasticizers can be used as superplasticizers. Water reducing admixture additive can be present in an amount from 0% to 5%, preferably 0.5 to 5%, by weight of the wet finish fiber-slurry mixture.

U.S. Pat. No. 6,620,487 to Tonyan et al., incorporated herein by reference in its entirety, discloses a reinforced, lightweight, dimensionally stable structural cement panel (SCP) which employs a core of a continuous phase resulting from the curing of an aqueous mixture of calcium sulfate alpha hemihydrate, hydraulic cement, an active pozzolan and lime. The continuous phase is reinforced with alkali-resistant glass fibers and containing ceramic microspheres, or a blend of ceramic and polymer microspheres, or being formed from an aqueous mixture having a weight ratio of water-to-reactive powder of 0.6/1 to 0.7/1 or a combination thereof. At least one outer surface of the SCP panels may include a cured continuous phase reinforced with glass fibers and containing sufficient polymer spheres to improve nailability or made with a water-to-reactive powders ratio to provide an effect similar to polymer spheres, or a combination thereof.

If desired the composition may have a weight ratio of water-to-reactive powder of 0.20/1 to 0.90/1, preferably 0.20/1 to 0.70/1.

Various formulations for the composite slurry (fiber-cement mixture) used in the current process are also shown in published US applications US2006/0185267, US2006/0174572; US2006/0168906 and US 2006/0144005, all of which are incorporated herein by reference in their entirety. A typical formulation would comprise as the reactive powder, on a dry basis, 35 to 75 wt. % (typically 45-65 or 55 to 65 wt. %) calcium sulfate alpha hemihydrate, 20 to 55 wt. % (typically 25-40 wt. %) hydraulic cement such as Portland cement, 0.2 to 3.5 wt. % lime, and 5 to 25 wt. % (typically 10-15 wt. %) of an active pozzolan. The continuous phase of the panel would be uniformly reinforced with alkali-resistant glass fibers and would contain 20-50% by weight of uniformly distributed lightweight filler particles selected from the group consisting of ceramic microspheres, glass microspheres, plastic (polymer) microspheres, fly ash cenospheres, and perlite. An example of a formulation for the composite slurry includes from 42 to 68 wt. % reactive powders, 23 to 43 wt. % ceramic microspheres, 0.2 to 1.0 wt. % polymer microspheres, and 5 to 15 wt. % alkali-resistant glass fibers, based on the total dry ingredients.

U.S. Pat. No. 8,038,790 to Dubey et al provides another example of a preferred formulation for the composite slurry which includes an aqueous mixture of a cementitious composition comprising, on a dry basis, 50 to 95 wt % reactive powder, 1 to 20 wt % of coated hydrophobic expanded perlite particles uniformly distributed as lightweight filler therein, the coated hydrophobic perlite particles having a diameter in the range of about 1 to 500 microns (micrometers), a median diameter of 20 to 150 microns (micrometers) and an effective particle density (specific gravity) of less than about 0.50 g/cc, 0 to 25 wt % hollow ceramic microspheres, and 3 to 16 wt. % alkali-resistant glass fibers for uniformly distributed for reinforcement; wherein the reactive powder comprises: 25 to 75 wt. % calcium sulfate alpha hemihydrate, 10 to 75 wt. % hydraulic cement comprising Portland cement, 0 to 3.5 wt. % lime, and 5 to 30 wt. % of an active pozzolan; and the panel having a density of 50 to 100 pounds per cubic foot.

Although the above compositions for the composite fiber-slurry mixture are preferred, the relative amounts of these ingredients, including the elimination of some of the above or the addition of others, may vary to suit the intended use of the final product.

Fiber-Slurry Feed Apparatus (Headbox)

Referring now to FIG. 9 a fiber-slurry feeder (also known as a forming assembly) receives a supply of fiber-slurry mixture 36 from the fiber-slurry mixer 32. In FIG. 9 the slurry feed apparatus is a fiber-slurry headbox 40, Different types of forming assemblies (slurry feed apparatus) are suitable on the forming line to produce the end product. A headbox is a preferred type of forming assembly. Other types of forming assemblies suitable in the present invention include: cylindrical screed rolls, roller coaters, vibrating plates with a gap at the bottom, vibrating plates (top and bottom) with a gap in the middle. FIGS. 9-15 show forming assembly (slurry feed apparatus) in the form of a headbox 40. Different types of forming assemblies may also be combined and/or used in series to produce the product. For example, a headbox may be used in combination with a screed roll or a vibrating plate.

One preferred forming assembly (slurry feed apparatus) for depositing a slurry upon a moving forming web of a structural cementitious panel (SCP panel) production line or the like where settable slurries are used for producing fiber reinforced concrete (FRC) building panels or board having a direction of travel, comprises:

- a headbox mounted transverse to the direction of travel of the moving web, having a transverse back wall, sidewalls, a concave transverse front wall, an open top, and an open bottom for directing slurry onto the forming web;
- a moveable dam releasably attached to the back wall, a seal attached to a bottom wall of the dam; and
- headbox height adjustment and support system extending from opposed said sidewalls.

The preferred headbox 40 is disposed transversely to the direction of travel "T" of the carrier 14. The fiber-slurry mixture is deposited in a cavity of the headbox 40 and discharges through a discharge opening of the headbox onto the moving carrier web 14 (conveyor belt).

The preferred headbox 40 consists of a corrosion resistant material (for example, stainless steel) and has specific geometry to provide a reservoir for the slurry, height adjustment and support mounts to adjust slurry gap opening, and a curved transition to a straight lip to smoothly and evenly distribute the flow of slurry. The curved transition also provides a means to introduce a reinforcing fiberglass scrim (if needed) from above the headbox. An adjustable seal is provided at the back of the headbox in order to prevent any leakage. Reinforcing glass fiber scrim may also be added from underneath the headbox. Both scrim systems have adjustment for tracking purposes. The vibration unit is a single mass system consists of a table, springs, and two motors which direct forces directly into the mat and cancel out in other directions. This unit is placed under the headbox and it extends about 2 to 24 inches, or about 3 to 12 inches or about 3 to 6 inches beyond the headbox. The headbox height adjustment and support system can either be manually adjusted, mechanically operated, or electrically driven. The entire forming assembly has several advantages:

The fiber reinforced cementitious slurry can be pumped through a hose and hose oscillator system into the headbox 40 or it may be dropped into the headbox 40 directly from the fiber-slurry mixer 32. The oscillator system would be used in either case to agitate the slurry. Thickness of the product formed using the headbox 40 is controlled by the slurry flow rate in the headbox 40, the amount of slurry elevation head in the headbox 40, and headbox discharge opening gap for a given line speed. The discharge opening gap of the headbox 40 is a transverse opening through which the fiber-slurry mixture discharges from the headbox 40 onto the moving carrier web 14. The fiber-slurry mixture from the headbox deposits onto the moving carrier 14 in one step at close to the desired thickness and finish of the final panel 55. Vibration may be added to improve formation and different forms of continuous reinforcements such as scrims, nonwoven fiber mats and rovings may be added to improve flexural strength of the formed product. For example, a vibration unit 50 may be located below the headbox 40 under the conveyor belt 14.

The vibration unit 50 is typically a single mass system of a table, springs, and two motors which direct forces directly into the deposited mat of fiber-cement slurry and cancel out in other directions. This unit 50 is placed under the headbox 40 and extends about 3 to 6 inches beyond the headbox.

The headbox 40 deposits an even layer of the fiber-slurry mixture of relatively controlled thickness upon the moving carrier web 14. Suitable layer thicknesses range from about 0.125 to 2 inches thick, preferably 0.25 to 1 inches thick, typically 0.40 to 0.75 inches thick.

The fiber-slurry mixture is completely deposited as a continuous curtain or sheet of slurry uniformly directed down to within a distance of about 1.0 to about 1.5 inches (2.54 to 3.81 cm.) of the carrier web 14.

As the fiber-slurry mixture 46 moves toward the moving carrier web 14, it is important that all of the slurry be deposited on the web.

Forming and Smoothing and Cutting

Upon the disposition of the layer of fiber-embedded settable slurry 46 as described above, the frame 12 may have forming devices provided to shape an upper surface of the setting slurry-fiber mixture 46 traveling on the belt 14.

In addition to the above-mentioned vibrating table (forming and vibrating plate) 50 that assists to smooth the slurry being deposited by the headbox 40, the production line 10 may include smoothing devices, also termed vibrating screed plates 52, to gently smooth the upper surface of the panel (see FIGS. 9 and 10).

By applying vibration to the slurry 46, the smoothing device 52 facilitates the distribution of the fibers throughout the deposited slurry 46 that will become the FRC panel 55, and provides a more uniform upper surface. The smoothing device 52 may either be pivoted or rigidly mounted to the forming line frame assembly.

After smoothing, the layer of slurry has begun to set, and the respective panels 55 are separated from each other by a cutting device 54, which in a typical embodiment is a water jet cutter. The cutting device 54 is disposed relative to the line 10 and the frame 12 so panels are produced having a desired length. When the speed of the carrier web (belt) 14 is relatively slow, the cutting device 54 may be mounted to cut perpendicularly to the direction of travel of the web 14. With faster production speeds, such cutting devices are known to be mounted to the production line 10 on an angle to the direction of web travel. Upon cutting, the separated FRC panels 55 are stacked for further handling, packaging, storage and/or shipment as is well known in the art.

Another feature of the present invention is that the resulting FRC panel 55 is constructed so the fibers 30 are uniformly distributed throughout the panel. This has been found to enable the production of relatively stronger panels with relatively less, more efficient use of fibers. The volume fraction of fibers relative to the volume of slurry in each layer preferably constitutes approximately in the range of 1% to 5% by volume, preferably 1.5% to 3% by volume, of the fiber-slurry mixture 46.

FIG. 10 shows the method of FIG. 9 as a composite view of a process flow chart for the portion of the cementitious panel production line suitable for use with the present fiber-slurry mixing device upstream of the headbox and a top view of the production line downstream of the headbox.

Variations of the Production Line

Figure 11:
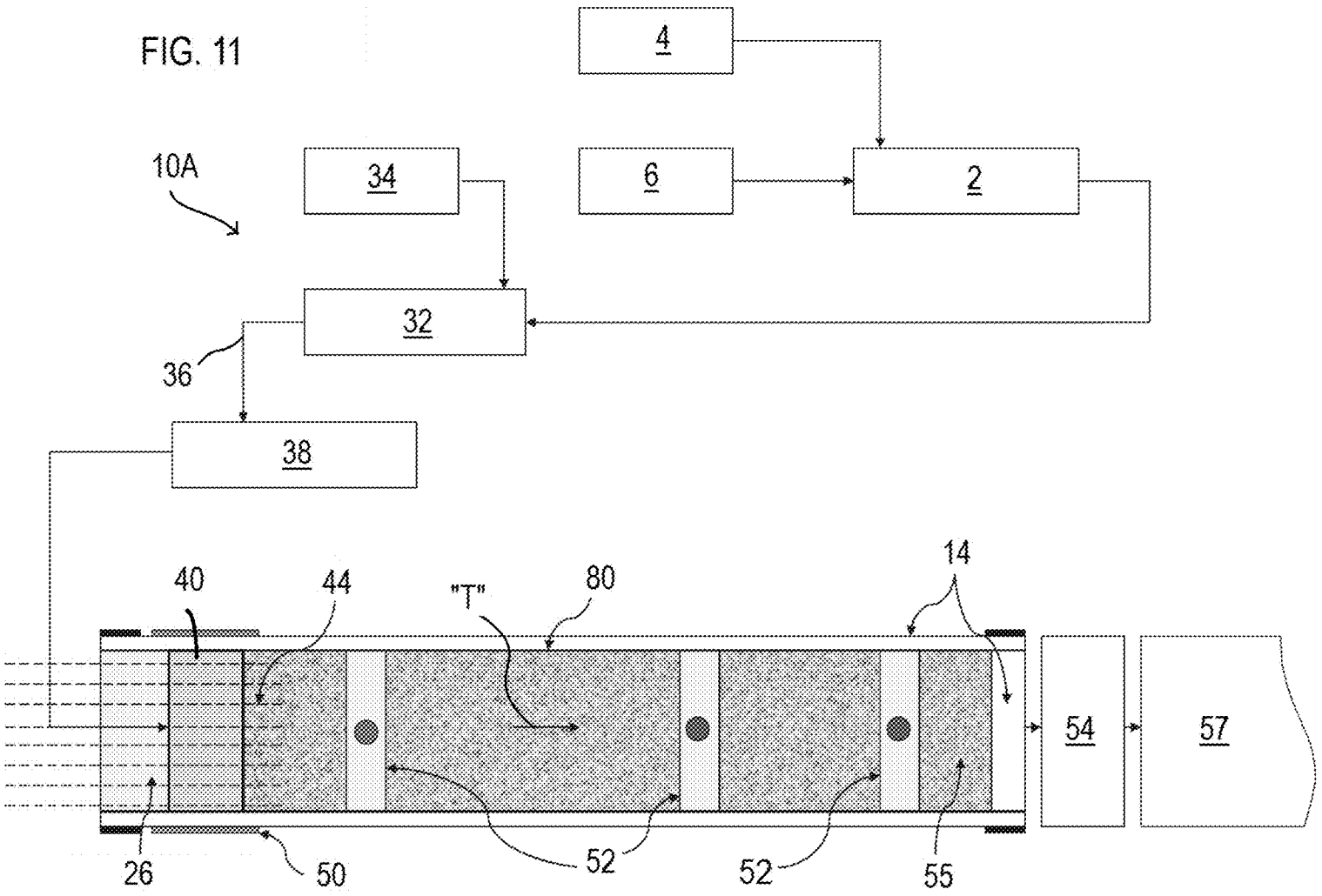
FIG. 11 shows a first variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox.

FIG. 11 shows a production line 10A which is a first variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox 40. This omits slurry accumulator and positive displacement pump 30.

Figure 12:
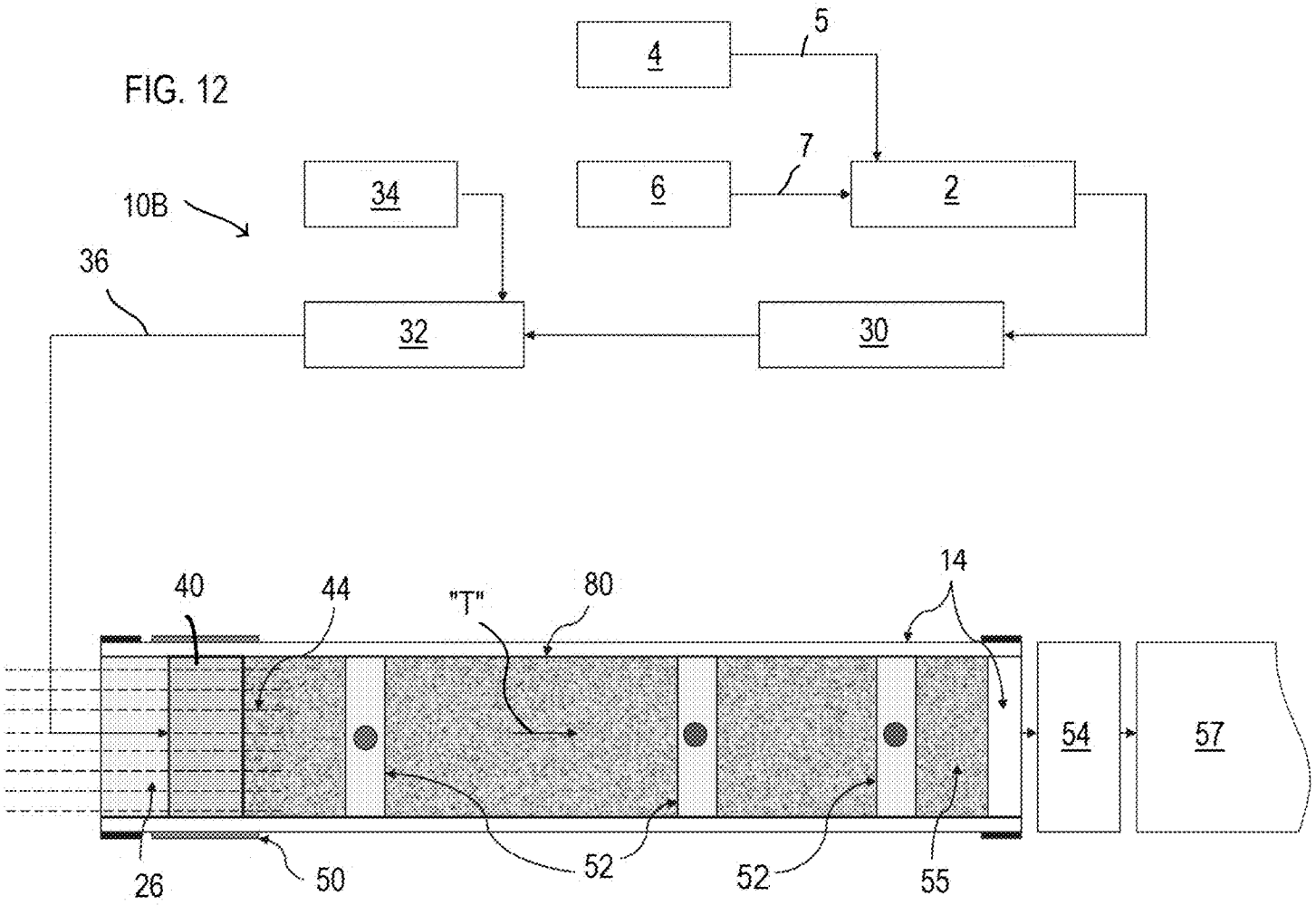
FIG. 12 shows a second variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox.

FIG. 12 shows a production line 10B which is a second variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox 40. This omits slurry accumulator and positive displacement pump 38.

Figure 13:
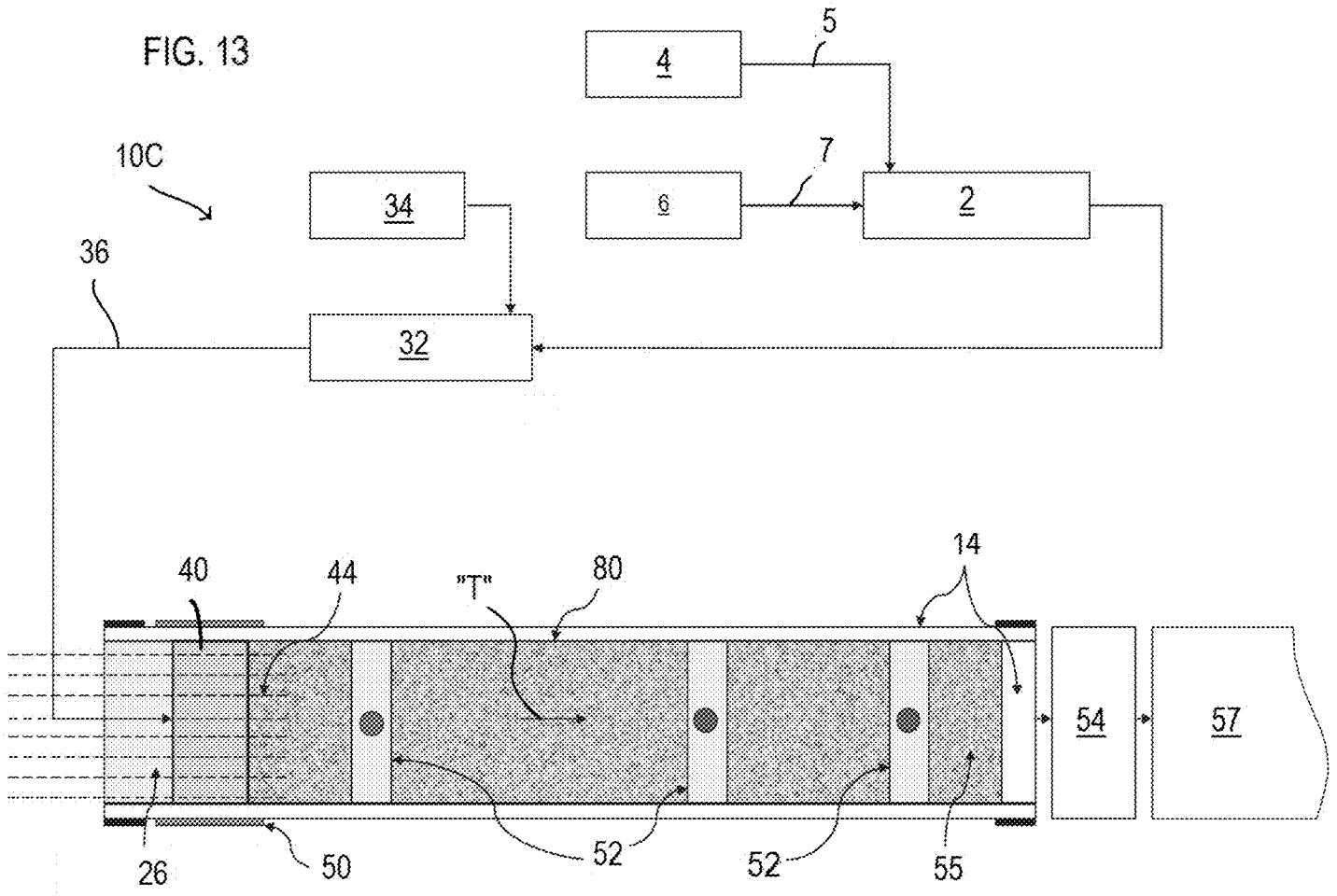
FIG. 13 shows a third variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox.

FIG. 13 shows a production line 10C which is a third variation of the cementitious panel production line of FIG. 9 as a composite view of a process flow chart for the portion of the cementitious panel production line suitable for use with the present fiber-slurry mixing device upstream of the headbox and a top view of the cementitious panel production line downstream of the headbox 40. This omits slurry accumulator and positive displacement pump 30 and slurry accumulator and positive displacement pump 38.

It is contemplated that the fiber-slurry mixer 32 and fiber-slurry mixture 36 in these production line variations, and other like numbered elements shown are the same as used in the production line 10 of FIG. 9 and FIG. 10.

FIGS. 9 through 13 show process flow diagrams for a manufacturing process that utilizes the fiber-slurry mixer of this invention for producing FRC panels. However, other uses and applications of the fiber-slurry mixer of this invention are possible and contemplated as part of this disclosure.

EXAMPLES

Example 1

FIG. 14 shows a photograph of a slump patty 101 of a fiber reinforced cementitious slurry mixture made using the fiber-slurry mixer of the present invention.

Example 2

FIG. 15 is a thickness profile of a ¾" thick panel FRC panel produced using fiber-slurry mixture produced by the method this invention. It shows consistent thickness achieved when a single layer was deposited. The fiber-slurry mixture contained Portland cement, gypsum, and glass fibers.

While a particular embodiment of the present slurry feed apparatus for fiber-reinforced structural cementitious panel production has been shown and described, it will be appreciated by those skilled in the art that changes and modifications may be made thereto without departing from the invention in its broader aspects and as set forth in the following claims.

What is claimed is:

1. A method for preparing cement composite slurry comprising:

feeding a liquid stream comprising water, into a continuous slurry mixer through a liquid stream inlet and feeding a stream of a dry cementitious powder into the continuous slurry mixer to form a cementitious slurry, said slurry mixer having a horizontally or vertically mounted impeller;

passing the cementitious slurry from the slurry mixer into a single pass horizontal fiber-slurry continuous mixer and passing a stream of reinforcement fibers into the horizontal fiber-slurry continuous mixer and mixing the cementitious slurry and the reinforcement fibers to form a fiber-slurry mixture, the horizontal fiber-slurry continuous mixer comprising an elongated mixing chamber defined by a horizontal (typically cylindrical) housing having an interior cylindrical side wall, at least one fiber inlet port to introduce reinforcement fibers through the interior cylindrical side wall directly into the chamber in a first feed section of the horizontal housing, said reinforcement fibers comprising fiberglass, polymeric materials, polypropylene, polyethylene, polyvinyl alcohol, carbon, graphite, aramid, ceramic, steel or a combination thereof, and at least one cementitious slurry inlet port to introduce cementitious slurry mixture through the interior cylindrical side wall directly into the chamber in a second feed section of the horizontal housing, a fiber-slurry mixture outlet port at a second discharge end section of the horizontal housing to discharge the fiber reinforced cementitious slurry mixture produced by the mixer, and a venting port to remove any air introduced into the mixing chamber from raw material feed, a rotating central horizontally oriented shaft mounted within the elongated mixing chamber traversing from one end of the fiber-slurry mixer to another end of the fiber-slurry mixer, a plurality of mixing and conveying paddles mounted on the horizontally oriented shaft of the fiber-slurry mixer at regular intervals and different circumferential locations, the paddles rotated about the horizontally oriented shaft within the horizontal housing, the paddles extending radially from a location on the shaft, the paddles comprising a pin engaged to a paddle head, the pin pivotally engaged to the horizontally oriented shaft and/or the paddle head to permit pivotal rotation of the paddle head relative to the respective location on the horizontally oriented shaft, wherein the plurality of paddles are arranged to mix the reinforcement fibers and cementitious slurry and move the cementitious slurry and reinforcement fibers being mixed to the fiber-slurry mixture outlet;

wherein the horizontally oriented shaft is externally connected to a drive mechanism and a drive motor, to accomplish shaft rotation when the fiber-slurry mixer is in operation;

wherein the cementitious slurry and reinforcement fibers are mixed in the mixing chamber of the horizontal fiber-slurry mixer for an average mixing residence time of about 5 to about 240 seconds while the rotating paddles apply shear force, wherein the central horizontally oriented shaft rotates at 30 to 450 RPM during mixing, to the fiber-slurry mixture to produce a uniform fiber-slurry mixture;

discharging the fiber-slurry mixture from the fiber-slurry mixer laterally relative to the horizontal housing through an opening in the side wall of the horizontal housing into and through the fiber-slurry mixture outlet port, wherein the dry cementitious powder comprises at least one of Portland cement, calcium aluminate cements (CAC), calcium sulfoaluminate cements (CSA), geopolymers, magnesium oxychloride cements (sorel cements), and magnesium phosphate cements.

2. The method of claim 1, wherein the chamber provides an average slurry residence time of about 10 to about 120 seconds and an RPM range of the paddle is 50 RPM to 250 RPM, wherein the fiber-slurry mixture discharged from the fiber-slurry mixer has a slump of 4 to 11 inches as measured according to a slump test using a 4 inch tall and 2 inch diameter pipe, wherein the discharged fiber-slurry mixture has a viscosity of less than 45000 centipoise.

3. The method of claim 1, wherein the horizontal fiber-slurry continuous mixer has a single said horizontal shaft.

4. The method of claim 1, wherein the horizontal fiber-slurry continuous mixer has at least two said horizontal shafts.

5. The method of claim 1, wherein the paddles are pivotally attached to the shaft.

6. The method of claim 1, wherein the horizontal housing defining the elongated mixing chamber is cylindrical.

7. The method of claim 1, wherein a gravimetric weighing system associated with a screw auger controls the rate of feed of the dry cementitious powder into the slurry mixer based upon a constant predetermined weight of powder per minute.

8. The method of claim 1, wherein the dry cementitious powder comprises Portland cement.

9. The method of claim 1, wherein the dry cementitious powder comprises a reactive powder portion and an optional lightweight filler portion, wherein the reactive portion comprises, on a dry basis, 35 to 75 wt. % calcium sulfate alpha hemihydrate, 20 to 55 wt. % hydraulic cement, 0.2 to 3.5 wt. % lime, and 5 to 25 wt. % of an active pozzolan.

10. The method of claim 9, wherein dry cementitious powder comprises 20 to 50% by weight of the lightweight filler particles on a dry basis, wherein the lightweight filler particles are selected from the group consisting of ceramic microspheres, plastic microspheres, glass microspheres, fly ash cenospheres and perlite.

11. The method of claim 1, wherein the dry cementitious powder comprises a reactive powder portion and a lightweight filler portion, wherein the reactive portion comprises, on a dry basis, 35 to 75 wt. % calcium sulfate alpha hemihydrate, 20 to 55 wt. % Portland cement, 0.2 to 3.5 wt. % lime, and 5 to 25 wt. % of an active pozzolan.

12. The method of claim 1, wherein orientation of the paddle head having a broad surface with respect to the central horizontally oriented shaft vertical cross-section is from about 10° to 80.

13. The method of claim 1, wherein the overall dimensions of the paddles are such that the clearance between the inner circumference of the mixer chamber and the paddle's furthermost point from the central horizontally oriented shaft is less than ¼ inch.

14. The method of claim 1, wherein the cementitious slurry and fibers are mixed in the mixing chamber of the horizontal fiber-slurry mixer to produce the uniform fiber-slurry mixture that has consistency that will allow the fiber-slurry mixture to be discharged from the fiber-slurry mixer and be suitable for being deposited uniformly as a continuous layer 0.125 to 2 inches thick on a moving surface of a panel production line to produce a fiber reinforced concrete panel.

15. The method of claim 1, wherein the paddles and elongated mixing chamber housing interior side wall are coated with a release material, to minimize buildup of the cementitious slurry on the paddles, wherein within the fiber-slurry mixer only the central horizontally oriented shaft, and the paddles rotating with the central horizontally oriented shaft, rotate within the horizontal housing as the fiber-slurry mixture passes through the elongated mixing chamber.

16. The method of claim 1, wherein the paddles are rigidly permanently mounted on the horizontally oriented shaft.

* * * * *